US005575591A

United States Patent [19]

Vanderklaauw

[11] Patent Number: 5,575,591

[45] Date of Patent: Nov. 19, 1996

[54] APPARATUS AND METHOD FOR A MODULAR SUPPORT AND LIFTING SYSTEM

[76] Inventor: Peter M. Vanderklaauw, 8360 SW. 186th St., Miami, Fla. 33157

[21] Appl. No.: 427,276

[22] Filed: Apr. 24, 1995

[51] Int. Cl.[6] ..... E02D 5/00

[52] U.S. Cl. ..... 405/230; 52/127.1

[58] Field of Search ..... 248/354.1; 405/230; 52/127.1, 127.2

[56] References Cited

U.S. PATENT DOCUMENTS

| | | | |
|---|---|---|---|
| 1,418,510 | 6/1922 | Alexander . | |
| 2,722,040 | 11/1955 | Ludowici . | |
| 3,273,859 | 9/1966 | Walli . | |
| 3,692,446 | 9/1972 | Vanderklaauw . | |
| 3,828,513 | 8/1974 | Vanderklaauw . | |
| 3,920,780 | 11/1975 | Vanderklaauw . | |
| 4,011,705 | 3/1977 | Vanderklaauw . | |
| 4,067,448 | 1/1978 | Bergeron . | |
| 4,206,162 | 6/1980 | Vanderklaauw . | |
| 4,251,974 | 2/1981 | Vanderklaauw . | |
| 4,782,634 | 11/1988 | Fry . | |
| 4,832,315 | 5/1989 | Vanderklaauw . | |
| 4,964,761 | 10/1990 | Rossi | 405/273 X |
| 4,980,999 | 1/1991 | Terenzoni . | |
| 5,022,199 | 6/1991 | Horii . | |
| 5,108,232 | 4/1992 | Strassil | 405/273 X |
| 5,246,311 | 9/1993 | West et al. | 405/230 |

OTHER PUBLICATIONS

*Popular Science*, "Upward Mobility in the Floodplain", May 1993; p. 35.

Power Post™ Brochure, Liftplate International Inc., Rev. Jan. 1994.

*Primary Examiner*—William P. Neuder

*Attorney, Agent, or Firm*—Jones, Tullar & Cooper, P.C.

[57] ABSTRACT

An apparatus and method for a modular structural support and elevating system for constructing temporary support structures. The system includes providing a plurality of generally identical building elements or cribs. The cribs are generally box shaped, and a first crib may be mated to a second crib for forming elongate support structures. The cribs also have an opening on each non-mating side able to receive various mounting components. The cribs further include connecting hardware for releasably connecting the cribs to one another. A hydraulic jacking system may be used with the cribs for progressively elevating or lowering a structure.

27 Claims, 15 Drawing Sheets

181
182
184
186
128
140
142
194
215
216
218
224
232
234
236

APPARATUS AND METHOD FOR A MODULAR SUPPORT AND LIFTING SYSTEM

FIELD OF THE INVENTION

This invention relates generally to a modular temporary support system which may be used in the construction and elevation of bridges, buildings, or other structures. More particularly, this invention relates to a modular support and lifting system which includes a plurality of generally identical building blocks and accessories which may be used to construct a variety of temporary support structures.

DESCRIPTION OF THE PRIOR ART

Temporary support systems are normally referred to as false-work, shoring, or cribbing. Conventional support systems are either made of large components, like scaffold sections, or they are custom-built from wood or steel. The scaffold approach is quite extensively used, and the scaffold materials are often reusable. However, scaffolds take up a large amount of space, and the load capacity and variety of applications are quite limited. Indeed, there have been dramatic failures where uneven settling of bearing soil surfaces has caused the failure of cross bracing, thus leading to buckling of the vertical enforcements.

Under the custom-built approach, support structures are designed for one specific project. A disadvantage of this is that these custom-built support structures take additional time to design and fabricate. The custom-built method also has the disadvantages of being expensive and wasteful of materials which often cannot be reused. Furthermore, conventional support systems usually do not include hydraulic jacks as an integral part of the system, making preloading of supports and elevating of a structure difficult.

SUMMARY OF THE INVENTION

An object of this invention is to have a standard building element that can be used interchangeably for a large variety of support conditions.

Another object of this invention is to provide a temporary support system which is easy to assemble and disassemble without the use of special or heavy lifting equipment.

A further object of this invention is to provide a modular support system which may be used to progressively elevate or lower a structure.

Still another object of this invention is to include hydraulic jacks as a natural component of the support system wherein the hydraulic jacks may be easily added where desired in the support system.

A primary feature of the present invention is that the main support structures are constructed from a plurality of small generally identical building blocks, or cribs. The cribs are box-like metal building elements which can be bolted to each other to form posts or beams. (The term "beam" refers to an elongate unit made up of two or more cribs that are bolted together and generally disposed horizontally, and the term "post" refers to an elongate unit made up of two or more cribs that are bolted together and generally disposed vertically.) The ends of the cribs are precision ground so that when the cribs are bolted together they form posts or beams which are perfectly straight and resistant to buckling.

The crib beams and crib posts may be assembled into frames using interchangeable connector parts. They may also be used individually as horizontal or vertical shores. (A "shore" being a beam or post that is used to support a load in compression along its elongate axis.)

With each crib weighing about 25 pounds the system of the present invention makes it easy to build false-work and support structures without the use of heavy lifting equipment. This easy-to-assemble feature of the present invention is particularly useful in difficult to reach places. Furthermore, the present invention provides for two different types of joints for use in connecting posts and beams in building support structures; one type of joint being a hinged joint; and the other type being a moment-resisting (stiff or rigid) joint. This enables the construction of a variety of useful support structures.

Also in accordance with the present invention, hydraulic jacks may be used to preload the support system or to lift a load to a higher elevation. In most conventional support systems hydraulics are a special feature rather than a natural component, and lifting a load to a higher elevation is generally not possible, or at least very difficult. However, with the present invention, special fixtures, loading frames, and cradles allow the installation of hydraulic jacks on the cribs of the present invention, which makes it simple to preload the support system or lift the load to a higher elevation.

BRIEF DESCRIPTION OF THE DRAWINGS

Additional objectives and advantages of the present invention will be readily apparent from the description of the accompanying drawings wherein.

DESCRIPTION OF THE PREFERRED EMBODIMENT

Figure 1:
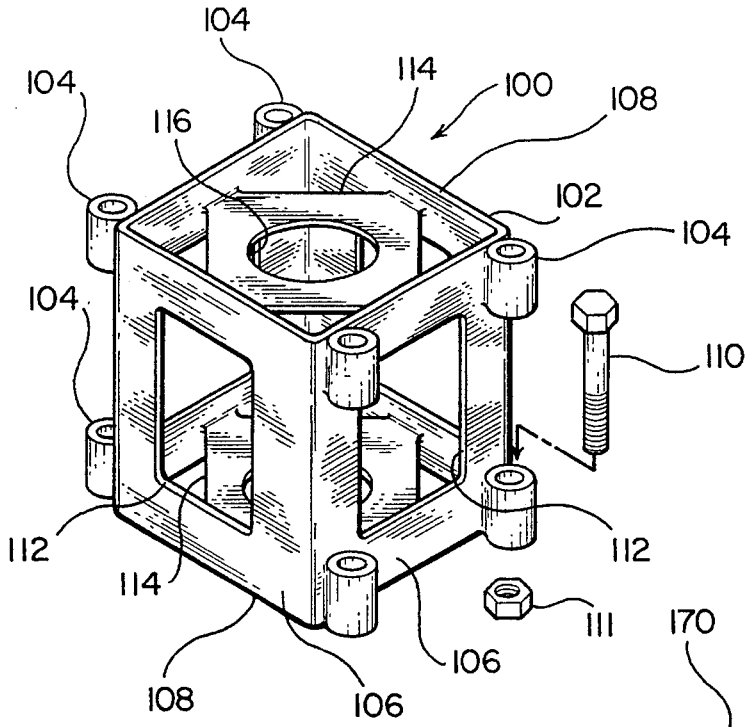
FIG. 1 is an isometric view of a crib of the present invention.

With reference to FIG. 1, there is shown a basic crib 100, which comprises the primary building element of the present invention. Crib 100 consists of a box-shaped thin-walled square tube 102 with eight short round tubes 104 welded near the corners. Crib 100 may be manufactured from a piece of square tubing, or by welding plates together, or by casting, or by other suitable means. Crib 100 is preferably constructed from steel, although aluminum, other metals, composites, or other suitable materials may also be used, depending upon the required end use.

Crib 100 has four side walls 106 and two mating ends 108. The short round tubes 104 make it possible to bolt a plurality of cribs 100 end-to-end using bolts 110, with four bolts 110 and four nuts 111 being used to securely mate two cribs 100 to each other. When mating a pair of cribs 100, the mating ends 108 to be joined are placed adjacent one another with short tubes 104 on each crib 100 in alignment. Bolts 110 are then inserted through the adjacent short tubes 104 of both cribs, and nuts 111 are installed and tightened to retain the cribs 100 in a mated configuration.

Mating ends 108 of crib 100 are precision ground or otherwise made accurately flat and parallel to each other to ensure the intimate contact required for the transfer of loads, and also to ensure the straightness of a post or beam constructed from a plurality of cribs 100. The precision machining of mating ends 108 becomes particularly important when constructing long posts or beams which may be subject to buckling.

Side walls 106 of crib 100 have rectangular openings 112. Openings 112 are intended to lessen the weight of crib 100, but more importantly are intended for mounting various components such as will be described in more detail below. In addition, while openings 112 are preferably rectangular, other shapes for the openings may also be used so long as the ability to mount the various components in openings 112 of cribs 100 is not impaired.

Crib 100 is shown having stiffener plates 114 mounted within square tube 102, near each mating end 108 of crib 100. Stiffener plates 114 are optional, and crib 100 may be used in a variety of applications without stiffener plates 114, some examples of which will be provided below. Stiffener plates 114 are intended to help prevent crib 100 from deforming, and generally add extra strength and integrity to crib 100. Stiffener plates 114 are provided with circular openings 116 which provide weight reduction, and which also provide access to the crib interior when required for inserting or manipulating various accessories, as will be described in more detail below.

In the preferred embodiment, mating ends 108 of crib 100 are 8 inches square, and side walls 106 are 10 inches long. These dimensions create a steel crib 100 that is approximately 25 pounds in weight, and which may be easily handled by a worker. In addition, while these are the preferred dimensions, it will be readily apparent to those skilled in the art that any of the dimensions may be easily modified for a particular purpose without deviating from the scope of the present invention.

Figure 2:
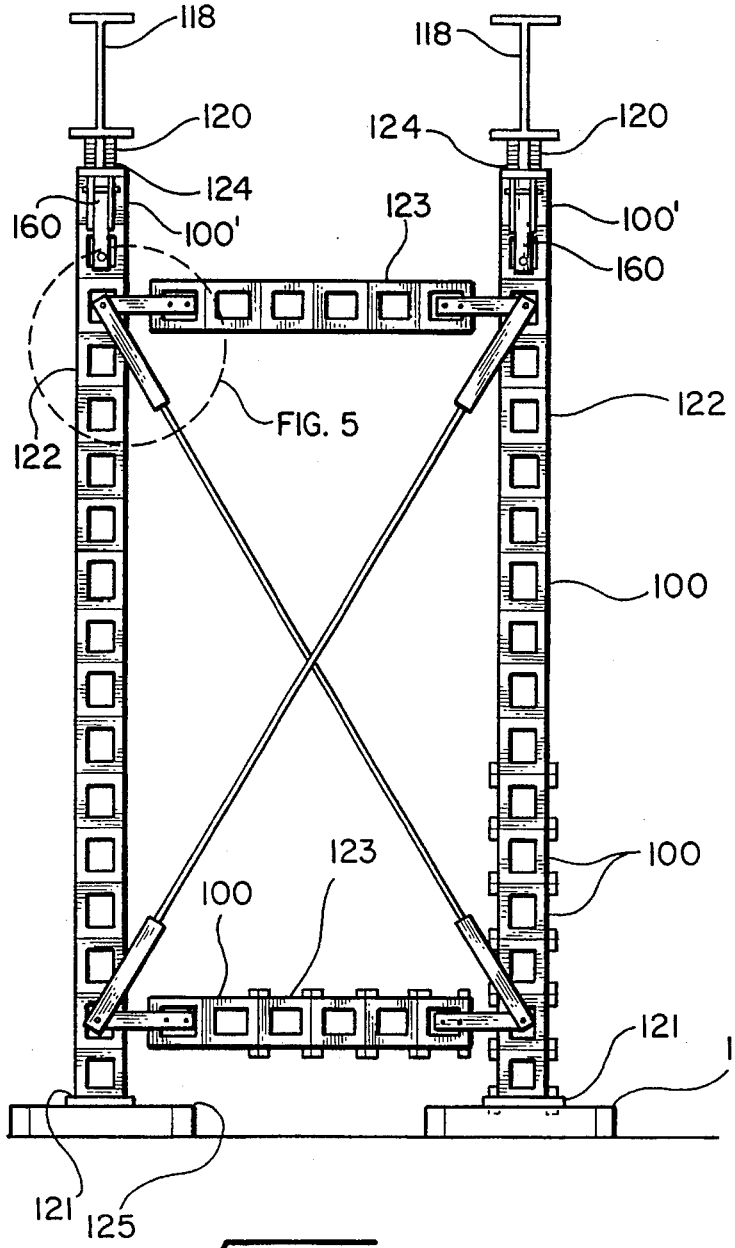
FIG. 2 is a frontal view of a vertical support frame made from a plurality of cribs using hinge-type joints.

Cribs 100 may be combined with each other or with a variety of connecting components to create a great variety of support structures. An example of a structural support frame 117 which may be constructed from a plurality of cribs 100 is illustrated in FIG. 2, with FIG. 3 being a side view of FIG. 2. Shown are two girder structures 118 supported on shims 120 which rest on posts 122. Posts 122 are mounted on a baseplate 121 which is welded to an H-frame 125 constructed from square tubes. Other types of mounting bases may also be used, as will be described below. Girders 118 may be I-beams, or may be any other type of structure to be supported by frame 117. A pair of beams 123 constructed from cribs 100 are connected to posts 122 for providing lateral support to frame 117.

Figure 4:
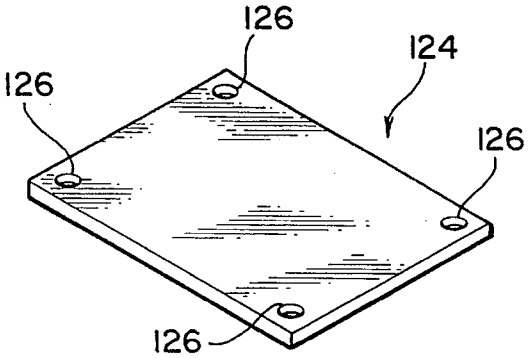
FIG. 4 is an isometric view of an end plate or cap plate.

End plates 124 are mounted on top of uppermost first crib 100', between shims 120 and first crib 100'. FIG. 4 illustrates an end plate 124, which is basically a square plate having holes 126 for mounting on a crib 100. End plates 124 may be used at the top and the bottom of a post or beam to serve as a bearing plate. Holes 126 are sized and spaced to fit the hole pattern of short tubes 104 of a crib 100 and to accommodate bolts 110.

Figure 3:
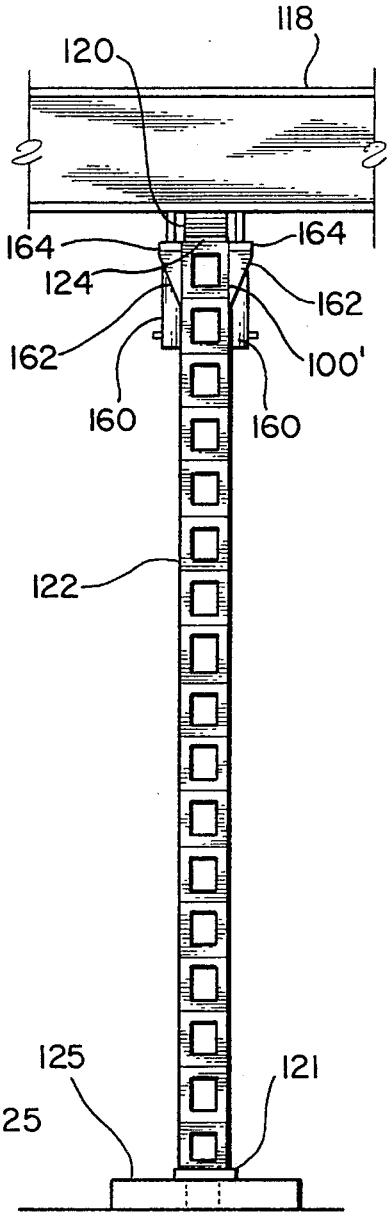
FIG. 3 is a side view of the support frame of FIG. 2.
Figure 6:
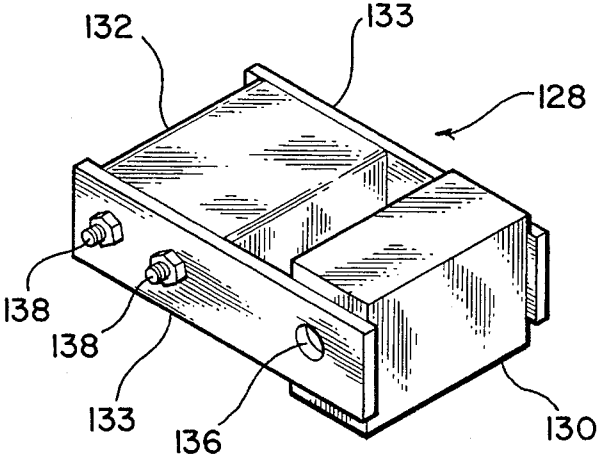
FIG. 6 is an isometric view of a 90 degree hinge-type post-to-beam connector.
Figure 5:
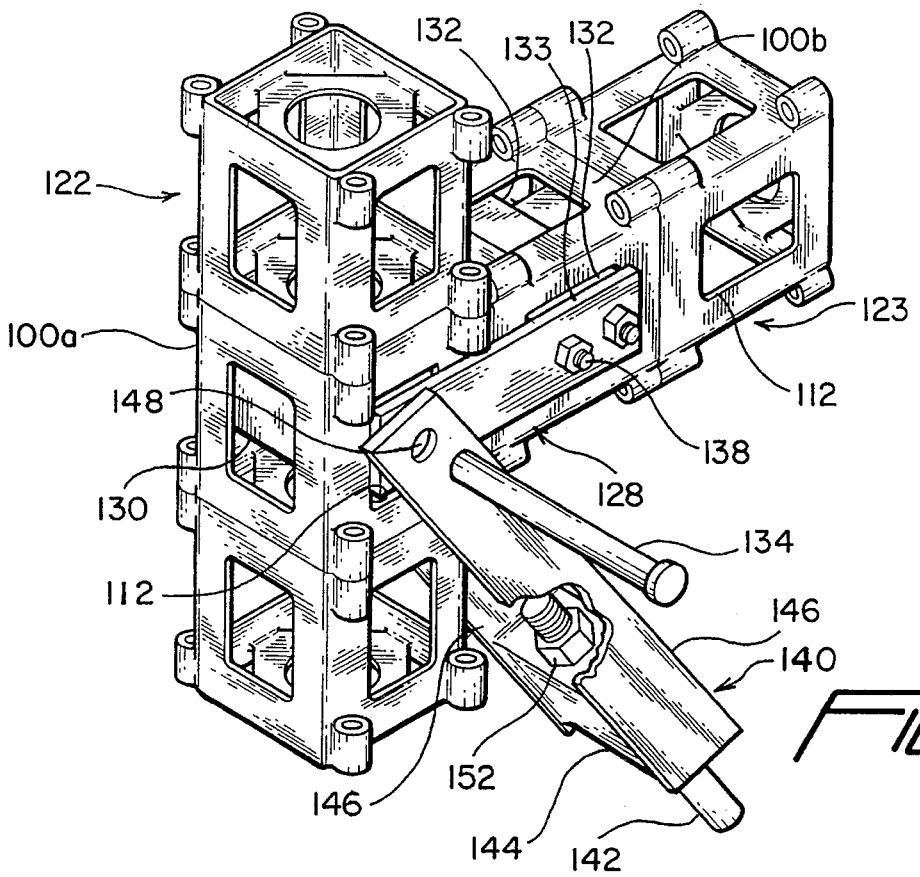
FIG. 5 shows an enlarged isometric view of a post-to-beam connection of FIGS. 2 and 3.

FIG. 5 shows an enlarged isometric view of a post-to-beam connection of FIGS. 2 and 3. A beam 123 is shown connected to a post 122 by a hinge-type connection. The connection is accomplished by using a hinge-type post-to-beam connector 128, as illustrated in FIG. 6. Post-to-beam connector 128 includes plugs 130 and 132 connected by wing blades 133. Plugs 130 and 132 are block shaped elements sized to fit snugly into openings 112 of crib 100. Plug pin 134 may be inserted through pin hole 136 in plug 130 and wing blades 133. Plug bolts 138 which pass through plug 132 mount the wing blades 133 to plug 132. It may be seen from FIG. 5 that plug 130 may be mounted within a vertically disposed crib 100*a*, and that plug 132 may be mounted in a horizontally disposed crib 100*b*, and that wing blades 133 then serve to connect horizontal crib 100*b* to vertical crib 100*a*.

Figure 7:
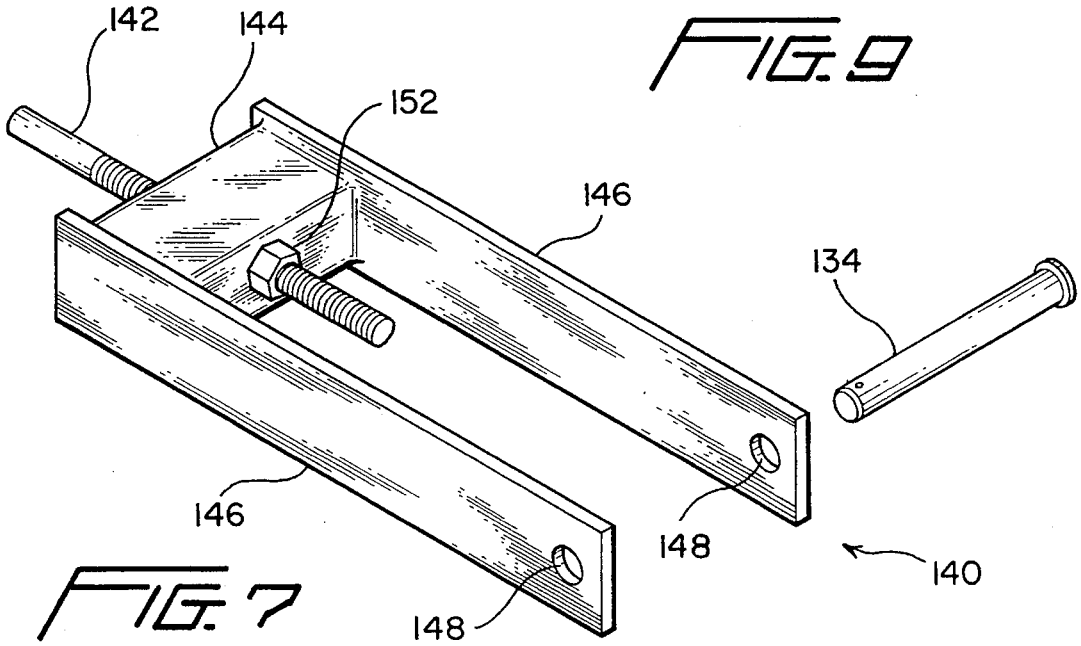
FIG. 7 is an isometric view of a clevis with tie rod and plug pin.

Also shown in FIG. 5 is a clevis 140 and a tie rod 142 for providing diagonal support to frame 117 of FIGS. 2 and 3. FIG. 7 illustrates a clevis 140 and a tie rod 142. The clevis 140 has a cross piece 144, and two clevis wing blades 146 with pin holes 148. Pin holes 148 are designed for plug pin 134 to pass through for connecting clevis 140 to plug 130. One end of tie rod 142 passes through a tie rod hole in cross piece 144, and the opposite end of tie rod 142 is connected to a similar clevis 140 at the diagonally opposed juncture of frame 117. Tie rod nut 152 on the tie rod 142 is used to tighten tie rod 142 in place.

FIGS. 2 and 3 also show hydraulic jacks 160 mounted at the top of posts 122 for use in preloading frame 117, and in supporting girders 118. This preloading feature of the present invention is particularly useful when constructing a support frame under existing structures, buildings, or the like. A frame 117, as is shown in FIGS. 2 and 3, may be constructed under an existing structure, and jacks 160 may then be activated to preload frame 117 to transfer support of the structure from its existing supports to frame 117.

Figure 8C:
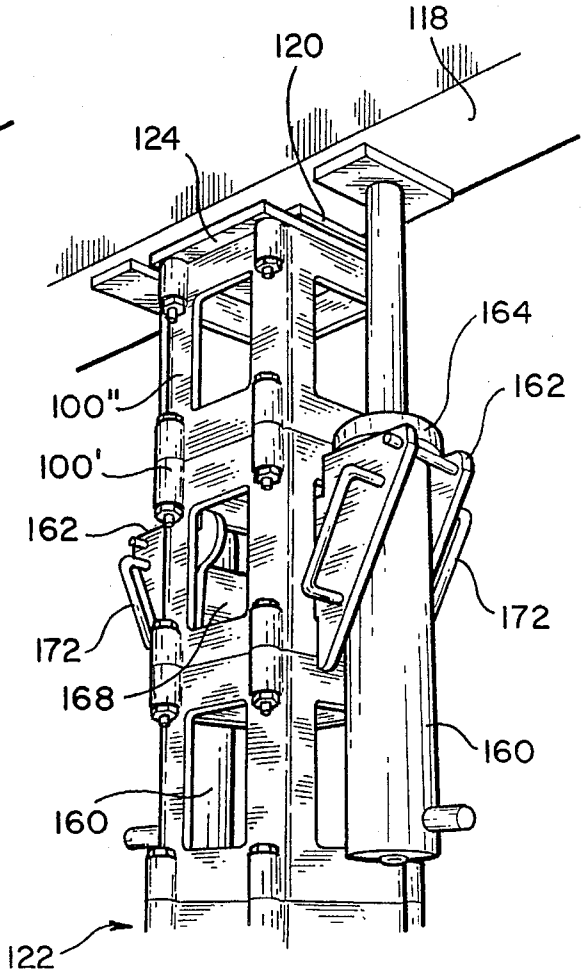
FIG. 8*c* shows the post of FIG. 8*a* with another crib added to the top of the post.
Figure 8B:
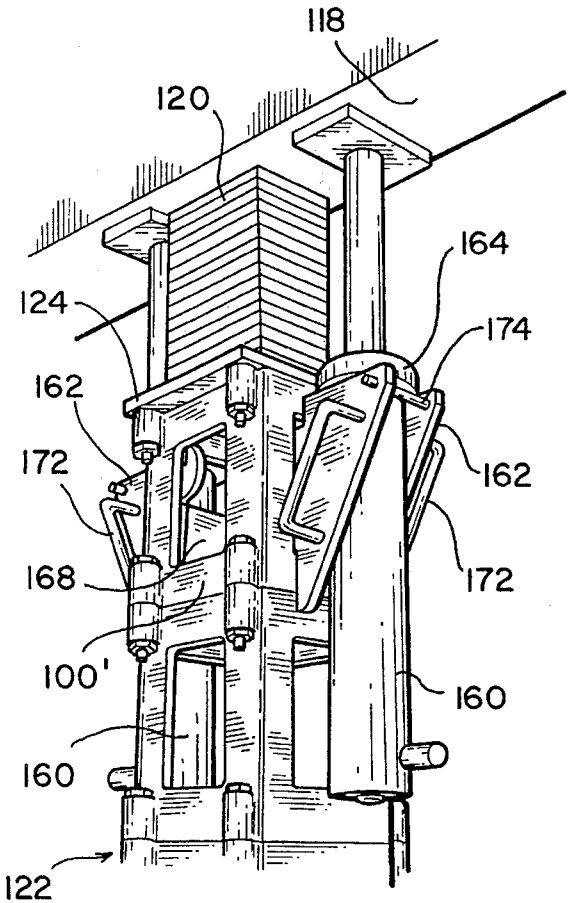
FIG. 8*b* shows the post of FIG. 8*a* with the jacks extended.
Figure 8A:
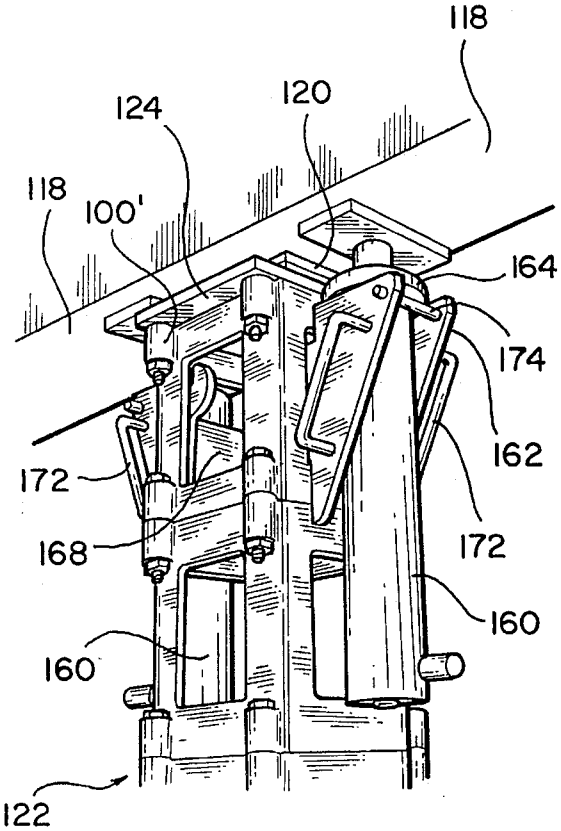
FIG. 8*a* is an enlarged perspective view of the upper portion of a post shown in FIGS. 2 and 3, showing cradles mounted in crib openings and supporting hydraulic jacks.

FIG. 8*a* is an enlarged perspective view of the upper portion of a post 122 shown in FIGS. 2 and 3. Post 122 is constructed from a plurality of cribs 100, and an uppermost first crib 100' is located less than one crib height below girder 118. A plurality of shims 120 are shown on top of first crib 100' and end plate 124 for supporting girder 118. During preloading, jacks 160 are activated and shims 120 are inserted until the pressure on the structure equals the load. The hydraulic pressure is then relieved and girder 118 is generally supported by shims 120, so that it is not necessary to maintain hydraulic pressure in jacks 160 once a preload of frame 117 has been established.

Figure 9:
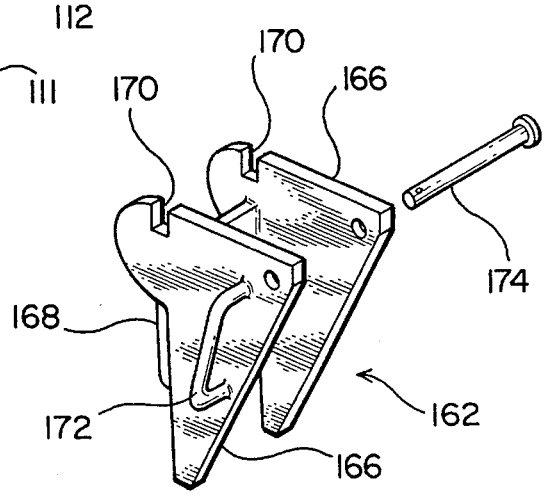
FIG. 9 is an isometric view of a cradle used to support a hydraulic jack.

A pair of cradles 162 are shown mounted within openings 112 in first crib 100'. Each cradle 162 supports a hydraulic jack 160 by means of flanges 164 which are integral with hydraulic jacks 160. Referring now to FIG. 9, there is shown an enlarged view of a cradle 162 which may be mounted in an opening 112 of a crib 100. Cradle 162 consists of two triangular wings 166 connected by a rectangular backplate 168. Wings 166 are designed to support a hydraulic jack 160 having an integral flange 164 formed on the jack cylinder, as shown in FIGS. 8*a*–8*c*. Slots 170 are formed on wings 166 to enable cradle 162 to hook into a crib opening 112 at the top of opening 112 while the lower edge of backplate 168 rests on the crib at the bottom of opening 112. Handles 172, located on either side of cradle 162, facilitate handling of cradle 162 during installation and removal of a cradle 162 from a crib 100. A cradle pin 174 is installable into cradle pin holes 176 for securing hydraulic jack 160 within cradle 162 between wings 166.

Although in the typical support structure of FIGS. 2 and 3 jacks 160 primarily serve to preload frame 117, it is also possible to use jacks 160 to raise or lower girders 118 to a different elevation. As illustrated in FIG. 8*b*, hydraulic jacks 160 may be activated to lift girder 118, creating sufficient space to place an additional second crib 100" on top of first crib 100'. During lifting, shims 120 are built up to prevent fall back of girder 118 in case of hydraulic failure.

When jacks 160 have been extended more than the height of one crib 100, shims 120 and end plate 124 may be removed from first crib 100'. Second crib 100" may then be mounted on top of first crib 100', and shims 120 and end plate 124 may be mounted upon the upper surface of second crib 100', as illustrated in FIG. 8*c*. Girder 118 may then be allowed to rest upon shims 120 by relieving the hydraulic pressure within jacks 160. Cradles 162 and jacks 160 may then be removed from first crib 100' and transferred to second crib 100", where the lifting cycle may then again be performed. In this manner, a structure may be progressively raised or lowered.

Figures 10, 11, 14, 16:
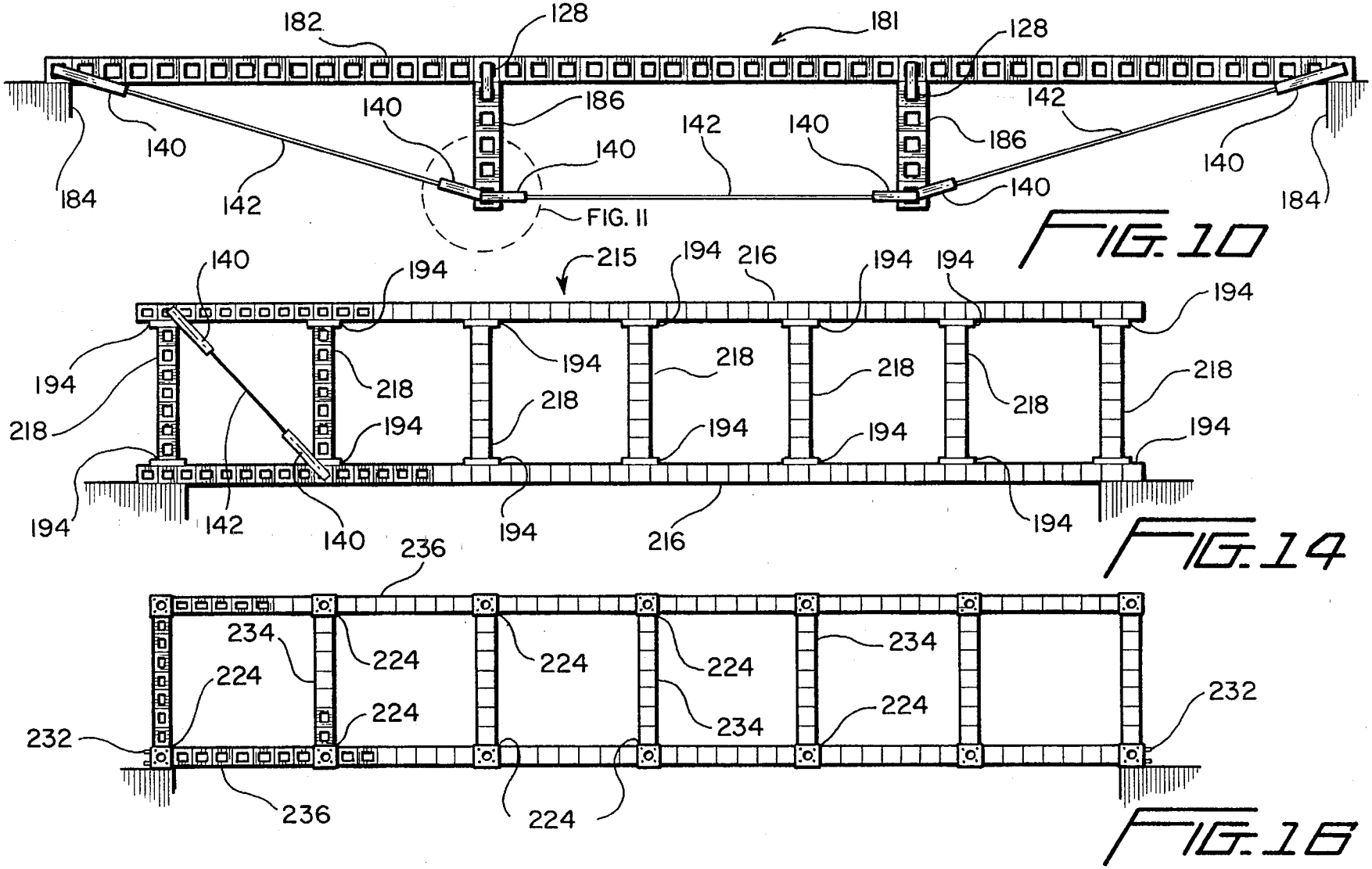
FIG. 10 is a diagram of a horizontal support structure or truss made of a plurality of cribs.
FIG. 14 is a horizontal support structure constructed using the T-bar moment-resisting connections of FIG. 12.
FIG. 16 is a horizontal support structure using a plurality of the cube connectors shown in FIG. 15.

Another exemplary structure which may be constructed from the components of the present invention is illustrated in FIG. 10. FIG. 10 shows a temporary bridge truss 181 constructed from a plurality of cribs 100. Truss 181 has a horizontal beam 182 which extends between two supports 184. A pair of vertical posts 186 are connected to beam 182 approximately one third of the length of beam 182 inward from supports 184. Posts 186 are connected to beam 182 using hinge-type post-to-beam connectors 128, as described above. In addition, tie rods 142 extend between the free ends of posts 186 and beam 182, and between the free ends of the two posts 186. Tie rods 142 are connected to posts 186 and beam 182, by means of clevises 140, as described above, and as illustrated in FIG. 11.

Figure 11:
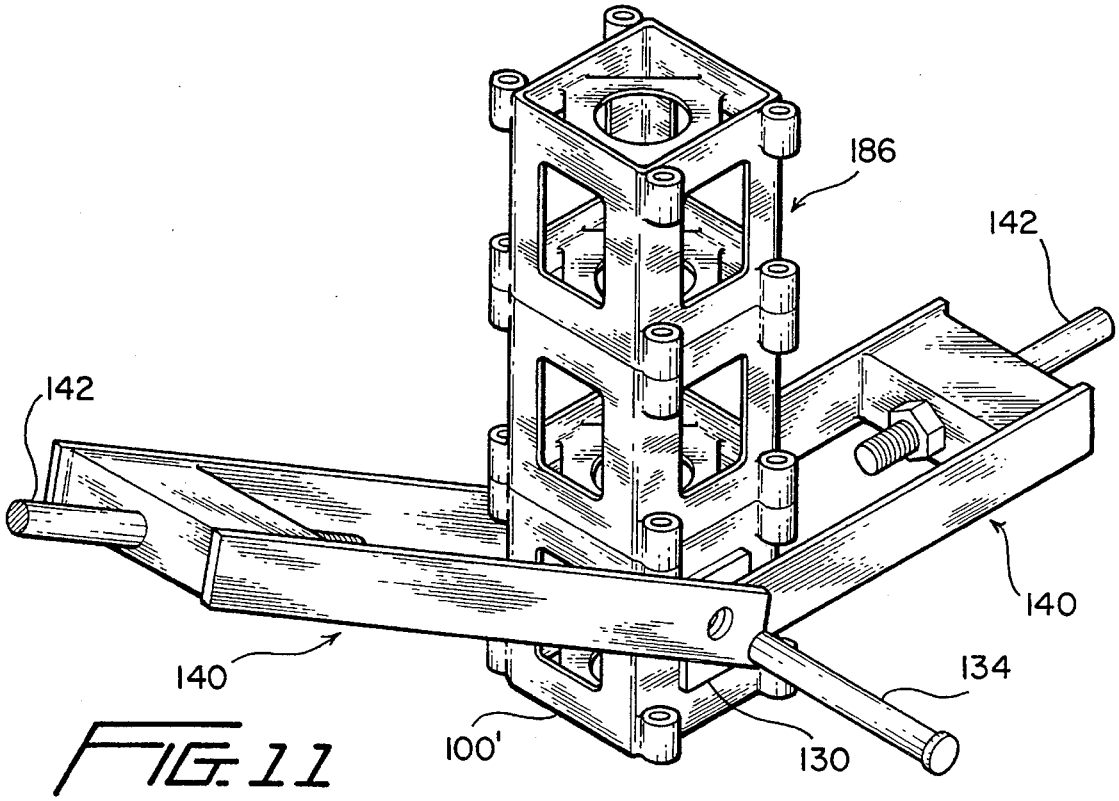
FIG. 11 is an enlarged isometric view of the lower end of a post of FIG. 10 showing the clevis attachments.

FIG. 11 is an enlarged isometric view of the end of one of posts 186, showing the attachment of clevises 140 in greater detail. A plug 130 is disposed within end crib 100' within opening 112. Clevises 140 are connected to plug 130 by inserting plug pin 134 through pin hole 148. Following installation of clevises 140, tie rods 142 may be tightened as described above to complete truss 181. From the foregoing examples, it will be apparent to one skilled in the art that any number of other structures may also be constructed using the components of the present invention, with it being understood that the examples described herein are merely illustrative.

Figure 13:
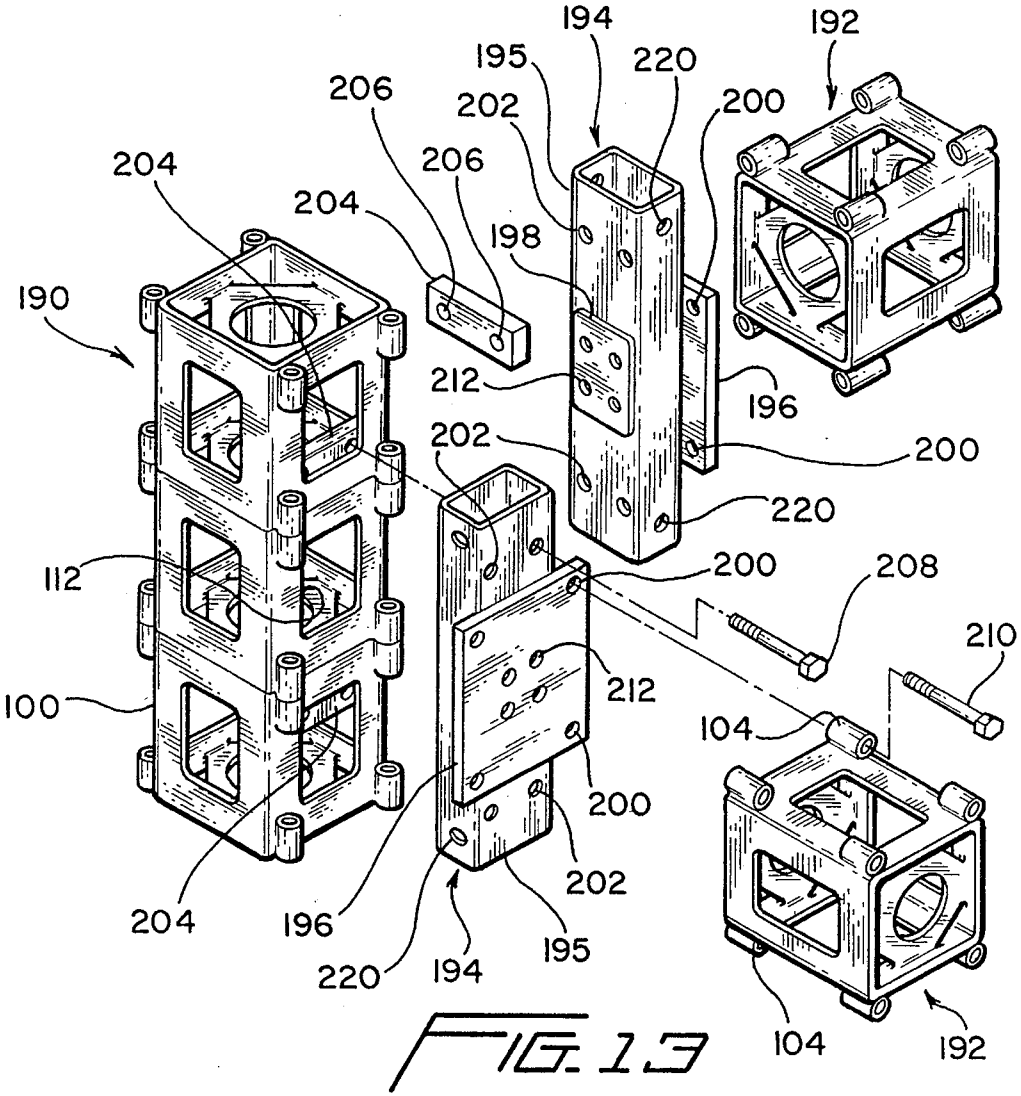
FIG. 13 is an exploded view of the T-bar connections of FIG. 12.
Figure 12:
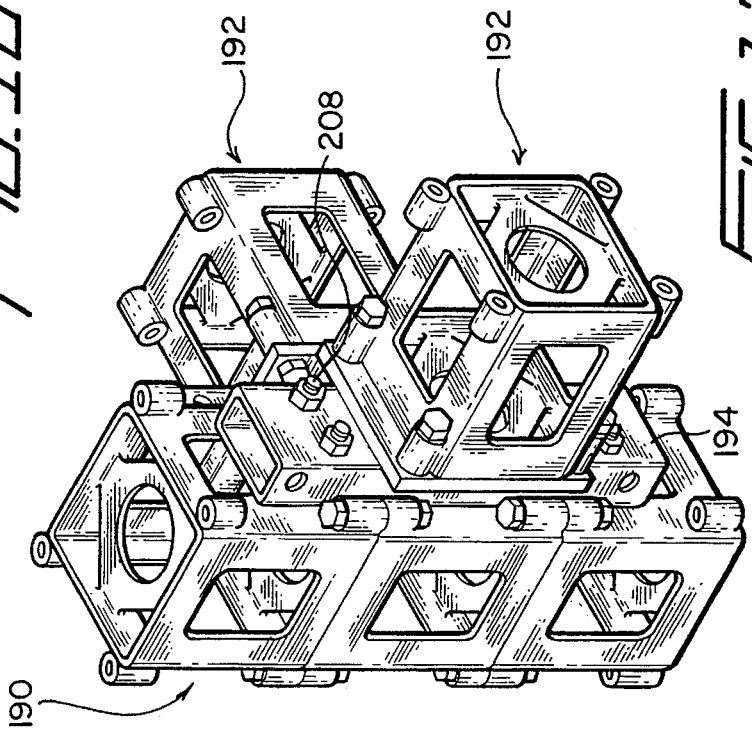
FIG. 12 is an isometric view of a pair of moment-resisting T-bar connections.

The joints illustrated thus far for connecting beams and posts are hinge-type joints. However, the present invention also provides for stiff or moment-resisting joints between beams and posts. FIG. 12 illustrates a first embodiment of a moment-resistant connection, with FIG. 13 being an exploded view of the connection of FIG. 12. FIGS. 12 and 13 show a post 190 constructed of a plurality of cribs 100. Connected to post 190 are a pair of beam cribs 192 which are the connecting ends of beams joined to post 190.

The moment-resistant connection between post 190 and beams 192 includes T-bars 194. As shown in FIG. 13, a T-bar 194 includes a length of a rectangular tube 195, to which is attached a flange plate 196 and a shear plate 198. Flange plate 196 has four bolt holes 200 that match the bolt pattern of short tubes 104 on cribs 100. Shear plate 198 fits closely within rectangular openings 112 on the side walls 106 of crib 100. A pair of bolt holes 202 are also located toward each end of rectangular tube 195 for mounting T-bar 194 to post 190. Back plates 204 are provided which have bolt holes 206, which match bolt holes 202 on T-bar 194. Back plates 204 are inserted into the interior of a crib 100 of post 190. Bolts 208 pass through holes 202 of T-bar 194. Bolts 208 then pass through opening 112 of crib 100 on post 190 and holes 206 in back plate 204. The side wall 106 the crib is thus clamped between back plate 204 and T-bar 194 when bolts 208 are installed in bolt holes 202 and 206 and tightened with nuts (not shown). Beam cribs 192 are attached to flange plate 196 using bolts 210 and nuts (not shown).

Four additional tension rod holes 212 are shown passing through flange plate 196 and shear plate 198. These tension rod holes 212 are reserved for passing tension rods or cables (not shown) through a line of cribs 100 when such tension rods or cables are structurally desirable to provide extra strength to the support structure.

FIG. 14 shows an example of a horizontal support structure which may be constructed using the T-bar connectors of FIGS. 12 and 13. In engineering terms this horizontal support structure is a Vierendeel truss, and is constructed of a pair of beams 216, and a plurality of vertical posts 218 connected to the beams by T-bars 194 which form rigid joints.

It may be noted that T-bar 194 also includes tie rod holes 220 located near the ends of rectangular tube 195 on the side walls. These holes 220 may be used to connect tie rods 142 to T-bars 194, as illustrated in FIG. 14, should such additional support be structurally desired. Tie rods 142 may be connected to T-bars 194 by means of clevises 140, the use of which is described above.

Figure 15:
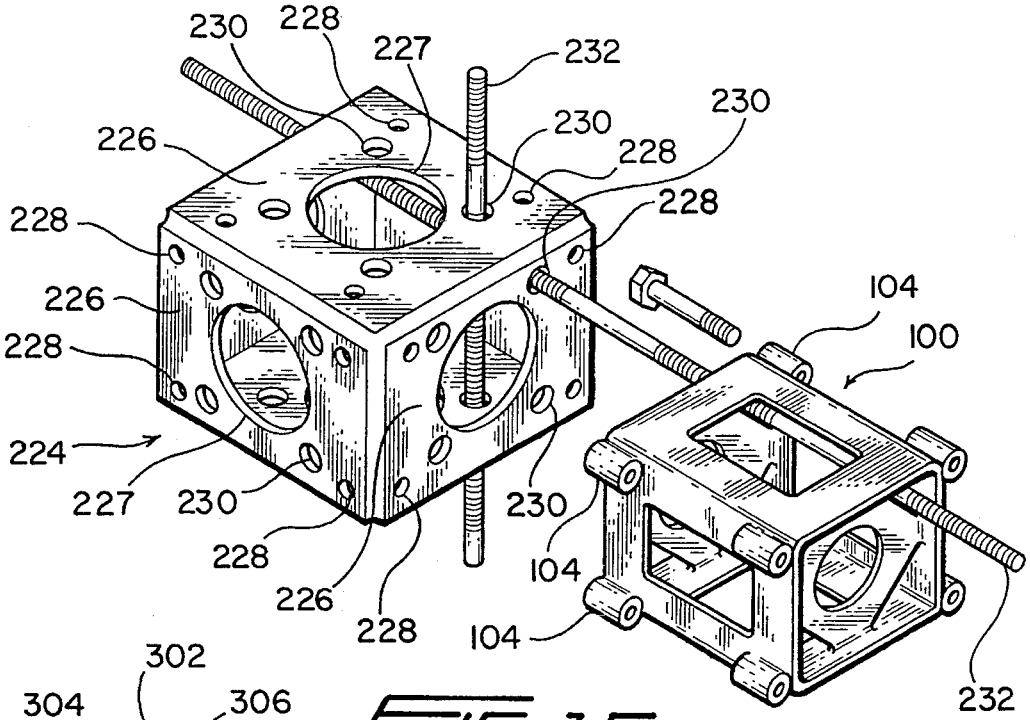
FIG. 15 is an isometric view of a moment-resisting cube connector and a crib.

An alternative type of moment-resisting connection is illustrated in FIG. 15, which shows a connecting cube 224 constructed from six plates 226, with each plate 226 being a mating surface capable of being connected to a crib 100. It may be seen that each plate 226 has four holes 228 which match the bolt configuration of short tubes 104 on crib 100. Each plate 226 also includes a large centrally located circular opening 227 for reducing weight and accessing the interior of cube 224. Holes 228 are on all six plates of the cube, thus facilitating a multi-directional connection. In addition to holes 228, there are four tension rod holes 230 in each plate 226 which are intended to pass tensioning rods 232. Tensioning rods 232 may sometimes be very desirable structurally to strengthen the supporting frame.

FIG. 16 illustrates a Vierendeel truss structure similar to that shown in FIG. 14, with the difference being that cubes 224 are used in place of T-bars 194 to rigidly connect posts 234 to beams 236.

Figure 17:
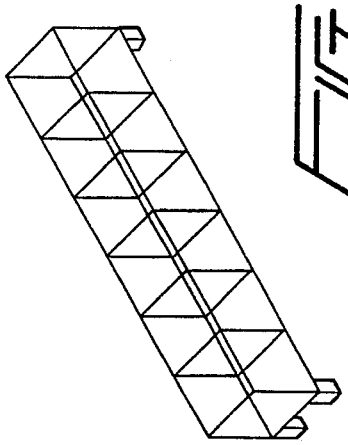
FIG. 17 is an isometric diagram of a three-dimensional support structure.
Figure 19:
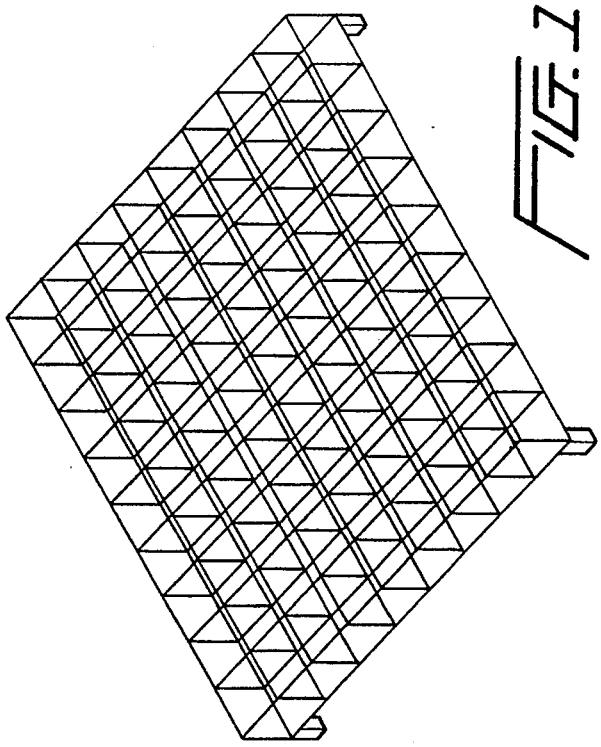
FIG. 19 is a space frame composed of cribs and moment-resisting connectors.
Figure 18:
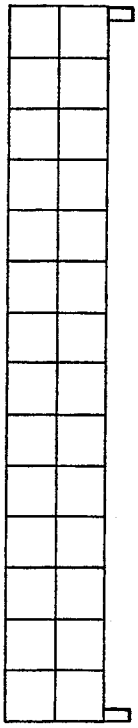
FIG. 18 is a frontal view of a support structure with two layers of panels.

FIGS. 17, 18, and 19 are illustrative of how assemblies of cribs can be configured into large structures, with the lines shown representing beams and posts constructed from a plurality of cribs, and connected by moment-resisting joints. The configuration of FIG. 17 shows a truss similar to that of FIGS. 14 and 16, except that it is three-dimensional with a second truss added to the first and connected by additional beams. Such a structure can be used as a temporary bridge or overpass. The configuration of FIG. 18 is the similar to that of FIGS. 14, 16, and 17, except that the support structure is two layers high and the span, as a result, can be much larger. The configuration of FIG. 19 can be used as a platform, space-frame roof, or the like.

Figure 20:
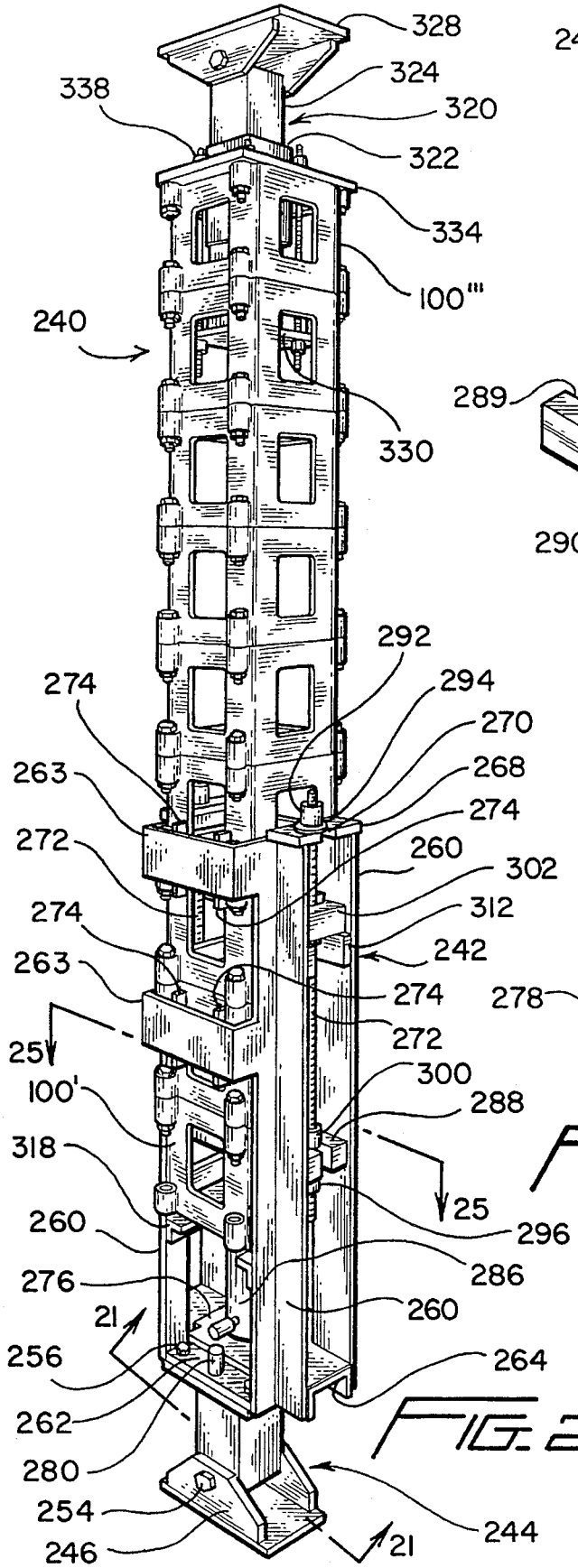
FIG. 20 is a perspective view of a loading frame by which cribs may be added to the bottom of a post during a lifting process.

While cradles 162 and jacks 160 described above may be used to elevate a structure, an alternative preferred elevating configuration of the present invention is illustrated in FIG. 20, which shows a crib post 240 constructed from a plurality of mated cribs 100, and which may be elevated by adding additional cribs 100 at the bottom of post 240, rather than at the top. Post 240 is contained within a sleeve-like loading frame 242 which facilitates elevation of post 240 and the addition or removal of cribs 100, while also providing lateral support to post 240.

Loading frame 242 is mounted on a swivel foot pedestal 244. The advantage of swivel foot pedestal 244 resides in its ability to eliminate eccentric loading which may cause post 240 to buckle if the eccentric loading becomes excessive. In cases where the post is short, or the bearing surfaces are horizontal, and buckling is not a concern, a non-swiveling base plate may be preferred, as shown in FIGS. 2 and 3.

Figure 21:
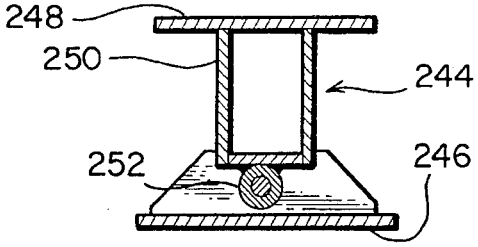
FIG. 21 shows a cross-sectional view of swivel foot pedestal.

FIG. 21 shows a cross sectional view of swivel foot pedestal 244. Swivel foot pedestal includes a swivel foot 246, a pedestal plate 248, and a rectangular tube 250. Rectangular tube 250 is welded to pedestal plate 248, and rectangular tube 250 also has a swivel tube 252 welded to its end opposite of pedestal plate 248. Swivel tube 252 is connected to swivel foot 246 by a swivel foot pin 254. Pedestal plate 248 has four holes (not shown) for mounting swivel foot pedestal 244 to the bottom of loading frame 242 by means of bolts 256.

Returning to FIG. 20, it may be seen that loading frame 242 is constructed of four angles 260, connected at their lower ends to base plate 262, and connected at their upper ends to two pairs of short U-shaped hoops 263. A channel 264 is welded on top of base plate 262, inverted between angles 260. Channel 264 serves to stiffen base plate 262, and to gusset angles 260. Cap plates 268 are welded to the tops of angles 260, on either side of loading frame 242. Cap plates 268 have slots 270 opening to the outside edge of cap plates 268 which enable the installation and removal of threaded suspender rods 272, as will be described below. Additional guide bars or skates 274 are welded to the inside surfaces of U-shaped hoops 263, creating guide spaces for short tubes 104 on cribs 100 to pass through as post 240 is elevated or lowered. Thus, loading frame 242 is configured for post 240 to fit snugly within loading frame 242, and to allow post 240 to move upward or downward in a telescoping fashion.

Figure 22:
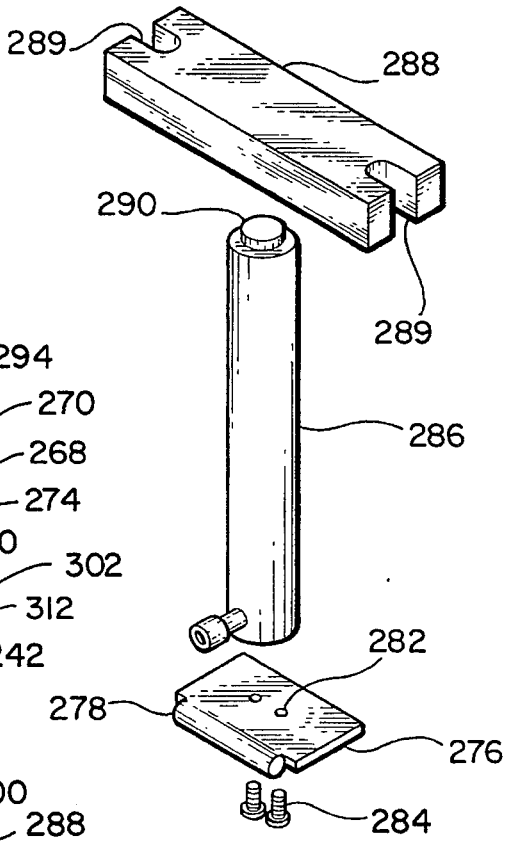
FIG. 22 shows a mounting plate, hydraulic jack, and crossbar.

To facilitate the elevating of post 240, a hydraulic jack mounting plate 276 is located on channel 264. As shown in FIG. 22 mounting plate 276 has a round bar 278 welded to one side. Round bar 278 hangs over the edge of channel 264 and fits within a space between channel 264 and a stud 280 which is welded to base plate 262. Round bar 278 thus serves as a hinge, being retained between stud 280 and channel 264. Mounting plate 276 has a pair of counter sunk holes 282 for receiving screws 284 for mounting a hydraulic jack 286 to mounting plate 276. Preferably one hydraulic jack 286 is used in the configuration of this embodiment. However, more than one jack 286 may be mounted on mounting plate 276, with the number of jacks 286 being limited by the space available between angles 260.

Figure 25:
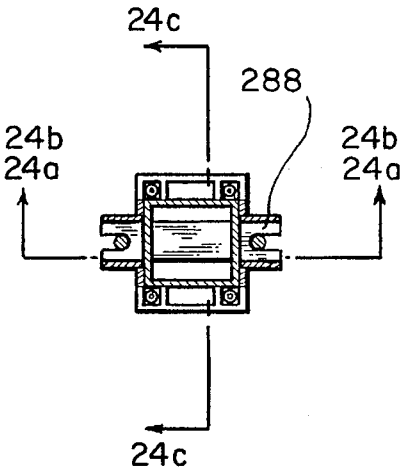
FIG. 25 is a sectional view of the post of FIG. 20 taken along line 25—25.

As illustrated more clearly in FIGS. **23*a*–23*c* and 24*a*–24*c*, hydraulic jack 286 may be rotated outward for receiving a crib 100' FIGS. 23***a*–23*c* are isometric views of post 240 illustrating some of the steps in a lifting cycle. FIGS. 24*a*–24*c* show corresponding sectional views of loading frame 242, with FIG. 25 illustrating how the sectional views are taken; FIG. 25 itself being a sectional view taken along line 25-25 of FIG. 20. Crib 100' is placed over jack 286 by passing jack 286 through the bottom of crib 100'. Crib 100' may then be slid into position under post 240, while jack 286 rotates back to a vertical position. A crossbar 288 as illustrated in FIG. 22 passes through openings 112 of crib 100', and piston rod 290 of hydraulic jack 286 bears against the underside of crossbar 288. Crossbar 288 has a slot 289 at either end for receiving suspender rods 272, so that crossbar 288 is retained within loading frame 242 and crib 100'. When hydraulic jack 286 is extended, piston rod 290 pushes against crossbar 288, which pushes against the edges of side walls 106 of crib 100', thereby lifting crib 100' and post 240.

Figure 26:
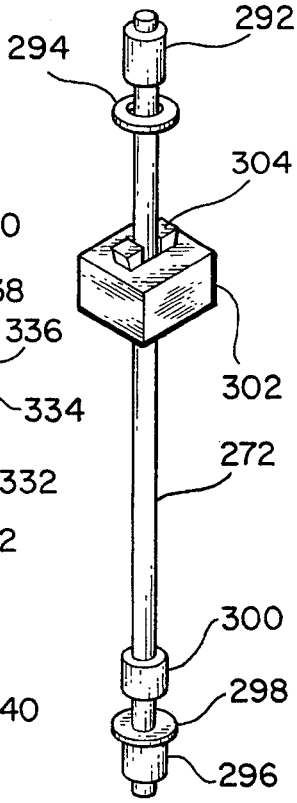
FIG. 26 shows a suspender rod and wedge block.

To prevent fall back of post 240 should the hydraulic pressure fail, suspender rods 272 are provided for supporting post 240. Suspender rods 272, are shown in FIG. 26, and include a check nut 292 and check washer 294 at the top end of suspender rod 272. Check nut 292 and check washer 294 retain suspender rod 272 within slot 270 on cap plate 268. At the bottom end of suspender rod 272 there is located a holding nut 296, and a holding washer 298 for fitting within slots 289 in crossbar 288 for supporting crossbar 288. A third nut 300 is located on suspender rod 272 above crossbar 288 for retaining suspender rod 272 more securely within slots 289 of crossbar 288.

As jack 286 is extended, suspender rods 272 rise with crossbar 288. As suspender rods 272 rise, a gap is created between check nut 292 and check washer 294 and cap plate 268. Thus, it is necessary to turn down check nut 292 during the lifting process, as illustrated in FIGS. 23*b* and 24*b*. This way, should the hydraulic pressure fail, post 240 will be supported by suspender rods 272.

Figure 27:
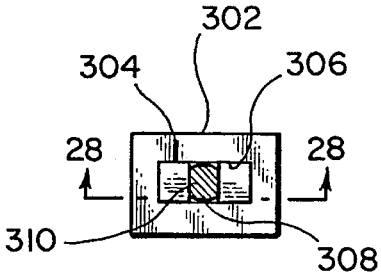
FIG. 27 shows a wedge block.
Figure 28:
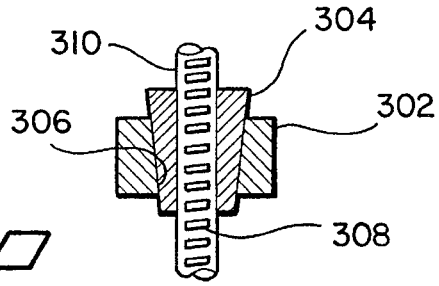
FIG. 28 shows the wedge block of FIG. 27 taken in section along line 28—28.

Also shown in FIG. 26 is a wedge block 302, which is illustrated in FIGS. 27 and 28. Wedge block 302 includes a pair of wedges or grippers 304 retained within a wedge-shaped hole 306 in wedge block 302. The preferred suspender rods 272 are oval shaped in cross section, having threads 308 on two sides, with flats 310 on either side. Suspender rod 272 fits closely within wedge block 302, and passes easily in the upward direction. However, should there be a sudden loss of hydraulic pressure, friction between rod 272 and grippers 304 will force grippers 304 more tightly into wedge-shaped hole 306, decreasing the clearance between grippers 304 and rod flats 310, halting the downward motion of rod 272 and thereby suspending the downward motion of post 240. As illustrated in FIG. 20, wedge blocks 302 are retained between angles 260 by shelf plates 312 which are welded to angles 260.

Figure 23C:
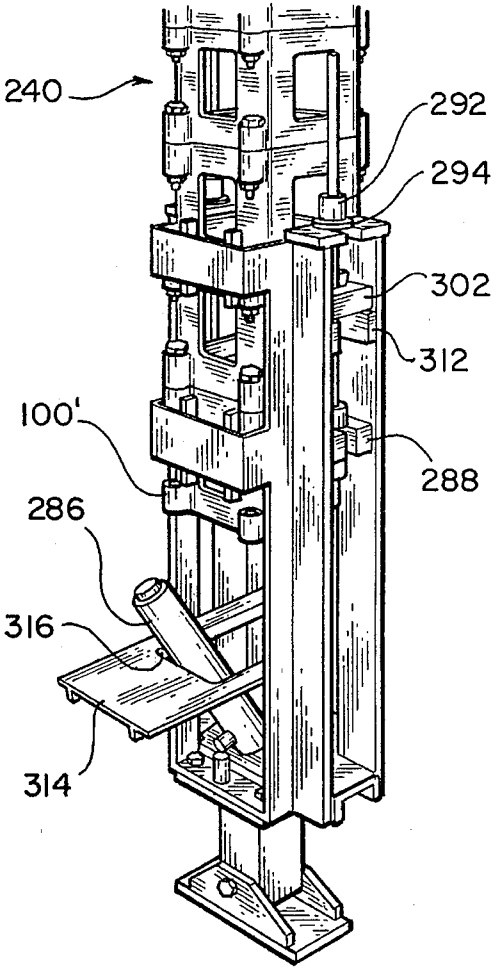
FIG. 23*c* shows the post of FIG. 23*b* with the suspender rods bearing the load, and the jack rotated to receive an additional crib.
Figure 23B:
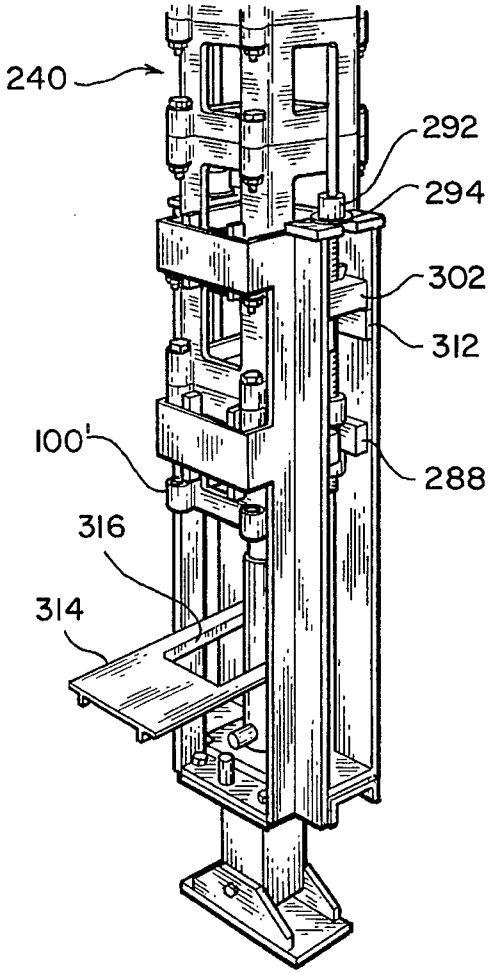
FIG. 23*b* shows the post of FIG. 23*a* with the hydraulic jack extended.
Figure 23A:
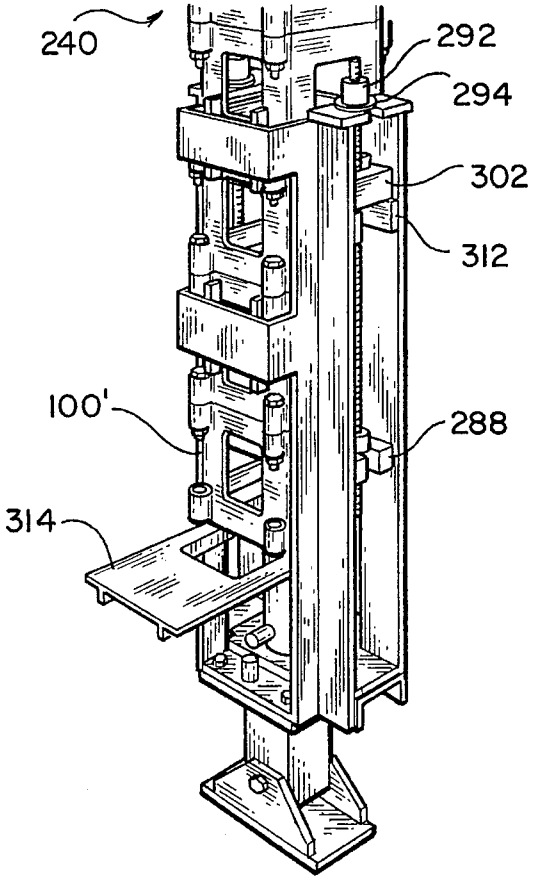
FIG. 23*a* shows the pose of FIG. 20 at the beginning of a lifting cycle.
Figure 24C:
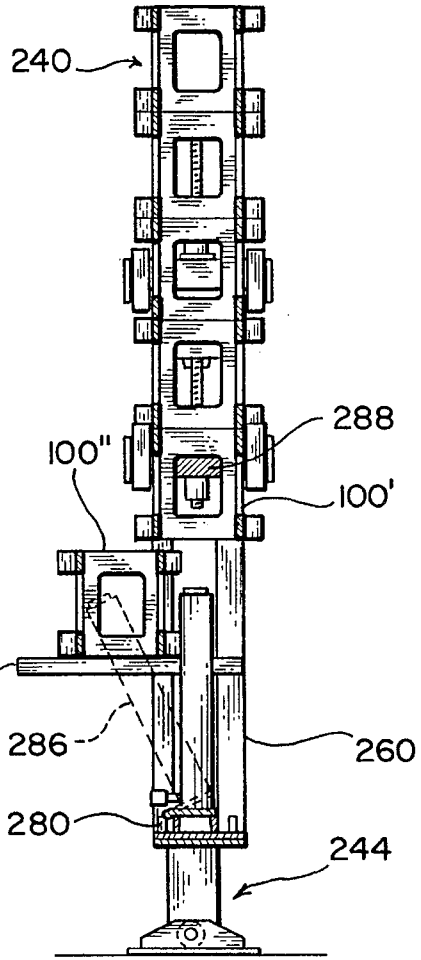
FIG. 24*c* shows the post of FIG. 20 taken in section along line 24*c*–24*c* shown in FIG. 25.
Figure 24B:
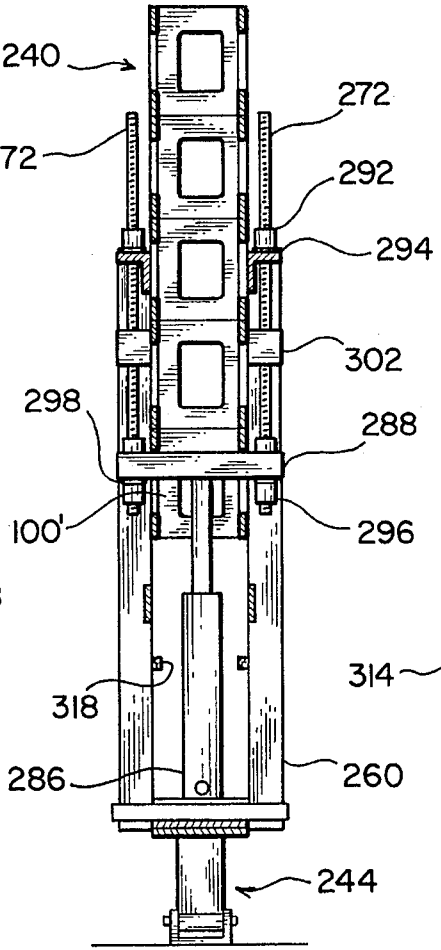
FIG. 24*b* shows the post of FIG. 24*a* with the jack extended.
Figure 24A:
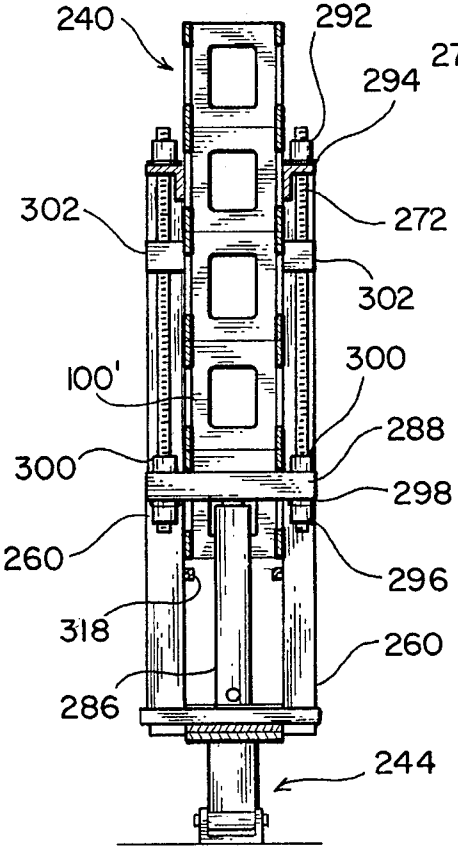
FIG. 24*a* shows the post of FIG. 20 taken in section along line 24*a*–24*a* shown in FIG. 25.

The elevation process is carried out by successively adding new cribs 100 at the bottom of post 240, as illustrated in FIGS. 23*a*–23*c* and 24*a*–24*c*. A first crib 100' is located in the starting position, as shown in FIGS. 23*a* and 24*a*, with jack 286 in the retracted position and crossbar 288 supporting first crib 100' and post 240. To start the lifting process, jack 286 is extended and post 240 is raised. When the stroke of jack 286 is complete, check nuts 292 are turned down on suspender rods 272, as illustrated in FIGS. 23*b* and 24*b*, and the hydraulic pressure then is relieved so that suspender rods 272 support the weight of post 240. In order for a second crib 100" to be placed below first crib 100', jack 286 is rotated outward as illustrated in FIGS. 23*c* and 24*c*, and second crib 100" is placed over jack 286. Second crib 100" is slid under post 246 and bolted to first crib 100'. To make this process easier, a loading tray 314 may be mounted on loading frame 242. Loading tray 314 includes a U-shaped opening 316 for allowing jack 286 to rotate, and fits within mounting angles 318 located on angles 260.

After second crib 100" is bolted to first crib 100', a second crossbar 288' (not shown) is placed within crib opening 112 of crib 100", and jack 286 is again activated. As second crossbar 288' rises, the load is transferred from first crossbar 288 to second crossbar 288'. First crossbar 288 may now be removed by removing suspender rods 272, which are also no longer under load. Check nuts 292 may then be rotated back up the length of suspender rods 272, and suspender rods 272 may be reinstalled on second crossbar 288' in the starting position. Grippers 304 in wedge block 302 are also loosened to allow wedge blocks 302 to be slid along the length of suspender rods 272 and reinstalled in the starting position. The lifting cycle may then be repeated.

To lower a structure, the above-described process is reversed. FIGS. 23*a*–23*c* and 24*a*–24*c* show check nuts 292 and wedge block 302 in operation simultaneously, which provides for double security against fall back. However, either one of check nuts 292 or wedge blocks 302 may be used without the other.

Also shown in FIG. 20 at the top of post 240, is a plunger 320. Plunger 320 is mounted in cribs 100 which do not include stiffener plates 114, and is useful for replacing shims or wedges which might other wise be required when there are several posts working in unison to elevate a structure. When elevating a structure using a plurality of posts 242, it is desirable that all the posts start with the bottom crib 100' at the same level, even though the upper points of loading may not be at the same level. In this way, when all of the posts are raised simultaneously, they start with the bottom crib at the same level. This is convenient when jacks 286 are all reset at the same time.

Figure 30:
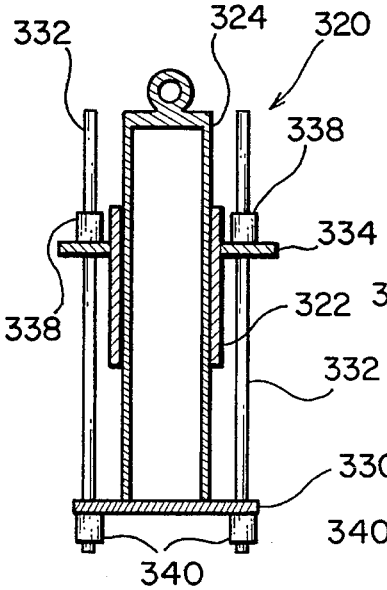
FIG. 30 shows the plunger of FIG. 29 in cross section.
Figure 29:
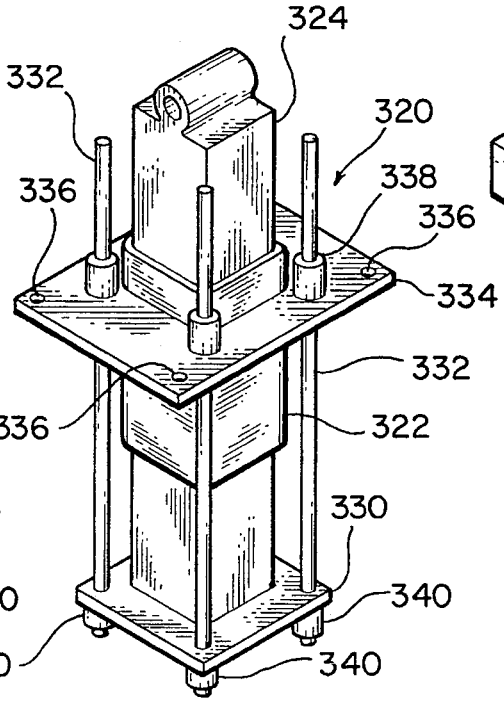
FIG. 29 shows a plunger for installation at the top of a post constructed of cribs.

Plunger 320 is illustrated in FIGS. 29 and 30, and includes a sleeve 322 and a square tubular piston 324. Piston 324 may have a swivel tube 326 welded to its top for mounting a swivel foot 328. Piston 324 also has a bottom plate 330 with four holes for receiving four plunger suspender rods 332. Sleeve 322 has a mounting flange 334 having four holes 336 for bolting flange 334 to short tubes 104 of a crib 100. Flange 334 has four additional holes for receiving four plunger rods 332. Plunger rods 332 are retained by upper nuts 338 and lower nuts 340. Thus, it may be seen that upper nuts 332 may be turned to raise or lower plunger rods 332, which will raise or lower piston 324.

When plunger 320 is installed on the top of post 240, flange 334 is fastened to the top crib 100''' using four bolts, and piston 324 fits down within the interior of post 240. In order to fill the gap between swivel foot 328 and a structure (not shown), upper nuts 338 are turned down, causing piston 324 to rise, bringing swivel foot 328 into contact with the structure.

Figure 31:
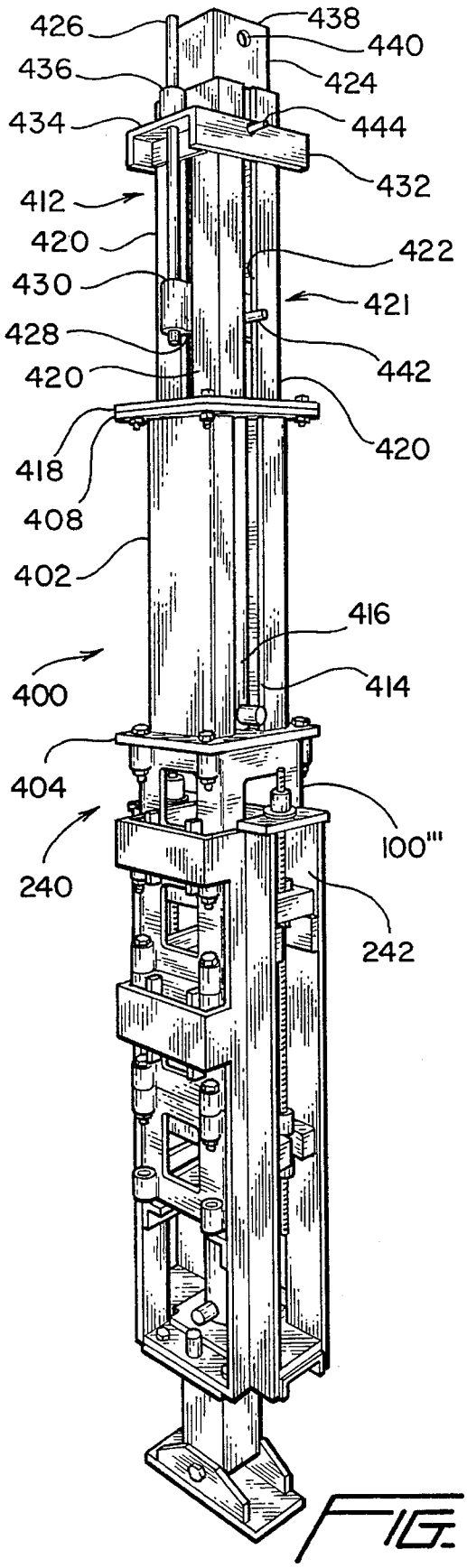
FIG. 31 is a perspective view of a post constructed from cribs and mounted within a loading frame, and in which a preloading module and a plunger module are included on top of the post.

FIG. 31 shows a crib post and loading frame similar to that of FIG. 20 and identical parts have the same numbers. The arrangement of FIG. 31 includes a preloading module 400 located at the top of post 240. Preloading module 400 is useful for preloading post 240 before actual lifting of a structure begins. As stated above, preloading may be important in both the supporting and lifting of a structure. If a load is applied to a post which has not been preloaded, the deformation of the post or "shortening" of the post may be as much as several inches. This "shortening" may be caused by seating at the bearing surfaces combined with compression of the components of the post. In some cases such a large shortening of a post is unacceptable.

As illustrated in FIGS. 32-35, preloading module 400 includes a square steel tube 402 mounted on a base plate 404. Base plate 404 has four bolt holes 406 for receiving bolts for attachment to a crib 100'''. Preloading module 400 may be mounted on cribs 100 which may or may not include stiffener plates 114 in their construction. Square tube 402 also has a flange plate 408 located on its other end, opposite of base plate 404. Flange plate 408 also has four bolt holes 410 for mounting a plunger module 412 on top of preloading module 400. One side of square tube 402 is formed with a vertical slot 414 along the entire length of square tube 402. Slot 414 gives access to the interior of preloading module 400 for inserting and removing a hydraulic jack 416 to be used in preloading. Reinforcing bars 417 may be welded to the interior corners adjacent slot 414 of square tube 402 to help accommodate for the strength lost in the wall of square tube 402 by forming slot 414.

Plunger module 412 is mounted on top of preloading module 400, and functions similarly to plunger 320 shown in FIGS. 20, 29, and 30, discussed above. Plunger module 412 includes a plunger module base plate 418 which is bolted to flange plate 408 of preloading module 400. Plunger module 412 includes four angles 420 which are welded upright to plunger module base plate 418, forming a slotted sleeve 421 having four longitudinal slots 422. A piston 424 is telescopically disposed within slotted sleeve 420, and is supported therein by suspender rods 426. A crossbar 428 is welded to the bottom of piston 424, and crossbar 428 passes through two of longitudinal slots 422 in slotted sleeve 421. Crossbar 428 includes a pair of suspender rod sockets 430 attached to either exterior end for receiving and retaining suspender rods 426.

A pair of rectangular bars 432 are welded on angles 420, near the top, on two sides of slotted sleeve 421. A pair of short angles which serve as nut support plates 434 are welded on the other two sides of slotted sleeve 421, between rectangular bars 432, and across the slots 422 which contain crossbar 428. Nut support plates 434 each have a hole through which passes one of suspender rods 426. Check nuts 436 are threaded onto suspender rods 426 on the upper side of nut support plates 434, and thereby support suspender rods 426, crossbar 428, and piston 424.

Piston 424 has a flat cap plate 438 rather than the swivel foot 328 shown in FIG. 20. Cap plate 438 is sufficient in most cases where the point of attachment is disposed in a horizontal position with respect to post 240. For sloping or changing positions a swivel foot 328 as shown in FIG. 20 is preferred. A tether hole 440 is located near the top of piston 424, and serves to accommodate a safety strap (not shown) which is useful for preventing post 240 from falling should post 240 come loose.

Also mounted on piston 424 are a pair of first spring studs 442 which extend through the pair of slots 422 not containing crossbar 428. A second pair of spring studs 444 are mounted on rectangular bars 432, directly above first spring studs 442. Spring studs 442, 444 are useful for receiving springs or bungee cords (not shown) which may be mounted thereon, extending from a first spring receiving stud 442 to a second spring receiving stud 444. The springs or bungee cords may be used to help offset the weight of piston 424 when it is necessary to turn down check nuts 436 on suspender rods 426.

It may be seen that piston 424 may be moved up and down within slotted sleeve 421 by adjusting check nuts 436. As check nuts 436 are turned down, suspender rods 426 are drawn up, thus raising crossbar 428 and piston 424. One purpose of plunger module 412 is to enable the cribs on multiple lifting posts to start at the same elevation prior to the start of a lifting cycle. Even where only a single post is being used, plunger module 412 is convenient for adjusting the position of the post end with respect to the load.

Figure 33:
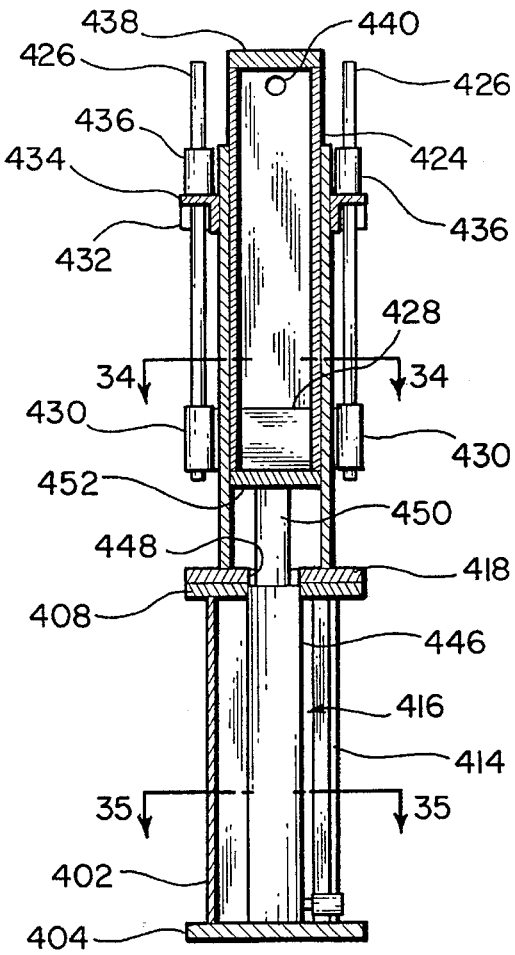
FIG. 33 is a cross-sectional view of the preloading module and plunger module of FIG. 32.
Figure 34:
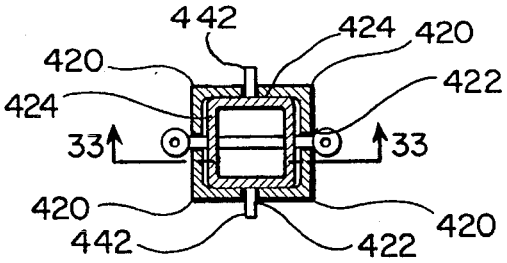
FIG. 34 is a cross-sectional view of the plunger module of FIG. 32 taken along line 34-34 in FIG. 33.
Figure 35:
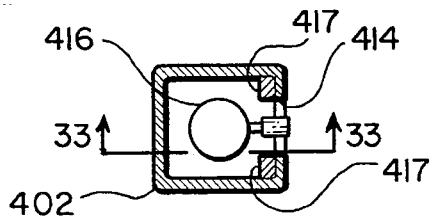
FIG. 35 is a cross-sectional view of the preloading module of FIG. 32 taken along line 35-35 in FIG. 33.
Figure 32:
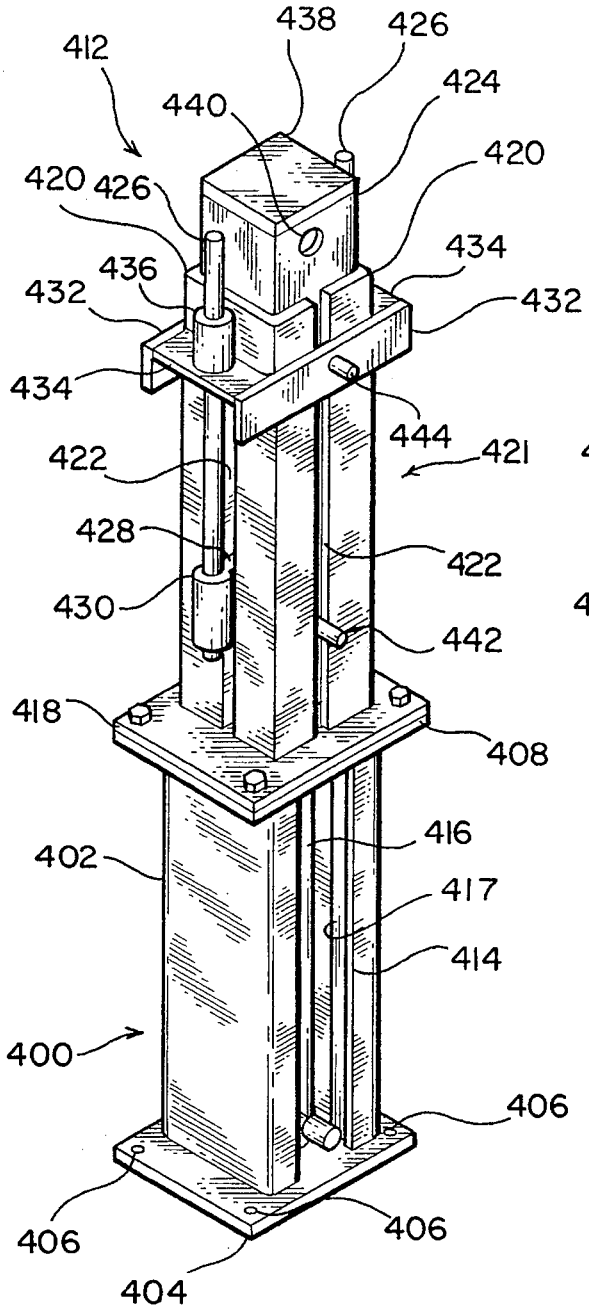
FIG. 32 is perspective view of the preloading module and plunger module of FIG. 31.

A second purpose of plunger module 412 is to enable preloading of post 240. As illustrated in FIG. 33, a hydraulic jack 416 may be installed through vertical slot 410 in square tube 402 of preloading module 400. The upper end of jack cylinder 446 fits within and is retained by hole 448 which is formed through flange plate 408 and plunger module base plate 418. Jack rod 450 may then be extended through hole 448, and press against bearing plate 452 on the bottom of piston 424 for applying a preload.

A preloading operation may be carried out by first extending piston 424 until cap plate 438 is in contact with a structure. This may be done manually, as described above, by placing springs upon spring studs 442, 444, which extend piston 424 into contact with the structure. Check nuts 436 may then be turned down, retaining piston 424 in contact with the structure. Jack 416 may then be activated and check nuts 436 turned down an additional distance to accommodate for "shortening" of the post. The amount of preloading to be applied in a particular case is normally specified by an engineer. The hydraulic pressure applied will determine the amount of the preload. When the proper preload pressure has been reached, and check nuts 436 have been turned down and tightened, the hydraulic pressure may be relieved. Jack 416 may then be removed and taken to other posts requiring preloading. Thus, it may be seen that the preloading module 400 in combination with plunger module 412 may be used to effectively apply a preload to a post 240.

Alternatively, of course, cradles 162 and jacks 160 may similarly be used for applying a preload, as shown in FIGS. 8*a*–8*c*, and as described above in reference to those figures. Also, where preloading is not required, plunger module 412 may be mounted directly to a crib 100 on top of a crib post.

Figure 36:
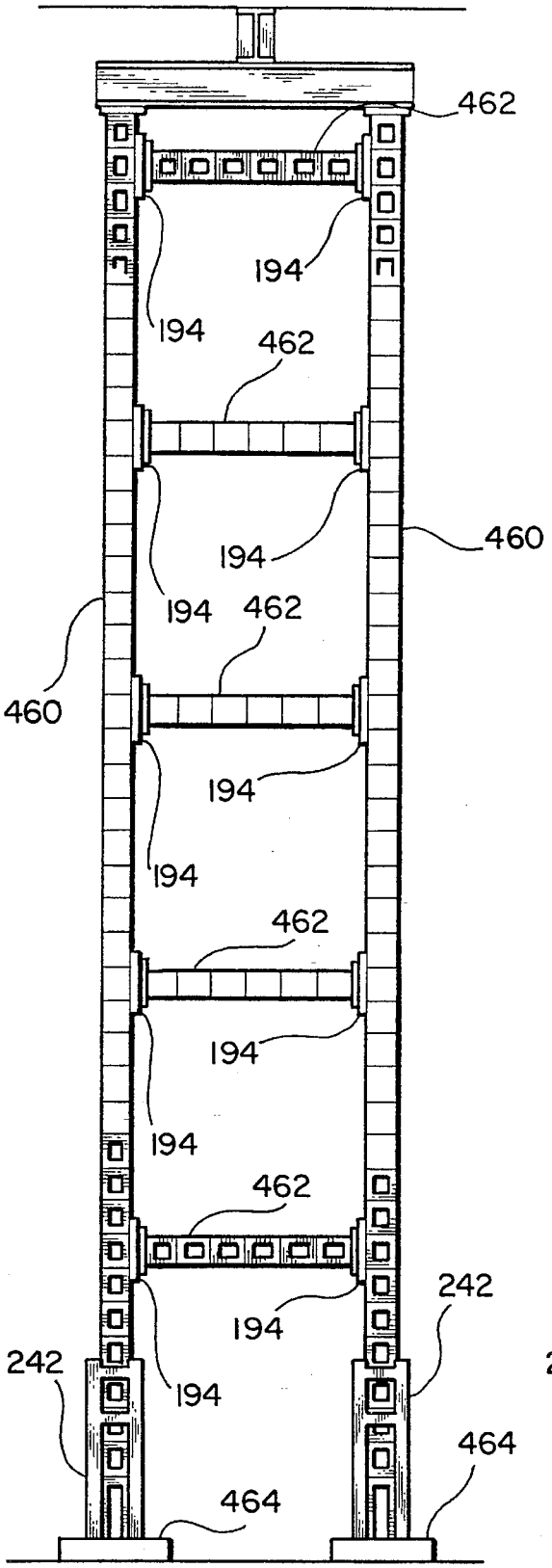
FIG. 36 shows two lifting posts constructed from cribs combined to lift a structure.

FIG. 36 shows an arrangement which may be referred to as a vertical truss, and which is an illustrative example of how elements of the elevating system of FIGS. 20 and 31 may be used for elevating more than one post concurrently. FIG. 36 shows a pair of posts 460 connected by a plurality of crib beams 462. Beams 462 are connected to posts 460 by T-bar connectors 194. Loading frames 242 are located at the base of posts 460. Loading frames 242 are shown mounted on a flat base 464, rather than on a swivel foot. Flat base 464 may be constructed from channels, I-beams, square tubing, or other structural components. The arrangement of FIG. 36 may be used for lifting various loads, with crib beams 462 serving to stiffen and provide lateral support to the arrangement. In addition, while FIG. 36 has been described in a two-dimensional arrangement, it will be apparent that it could easily be constructed as three dimensional (not shown), with four posts 460 each being connected in a box-like fashion by beams 462. Such a three-dimensional arrangement would be useful for a variety of lifting jobs, such as elevating a water tank from ground level to an installation elevation.

Figure 38:
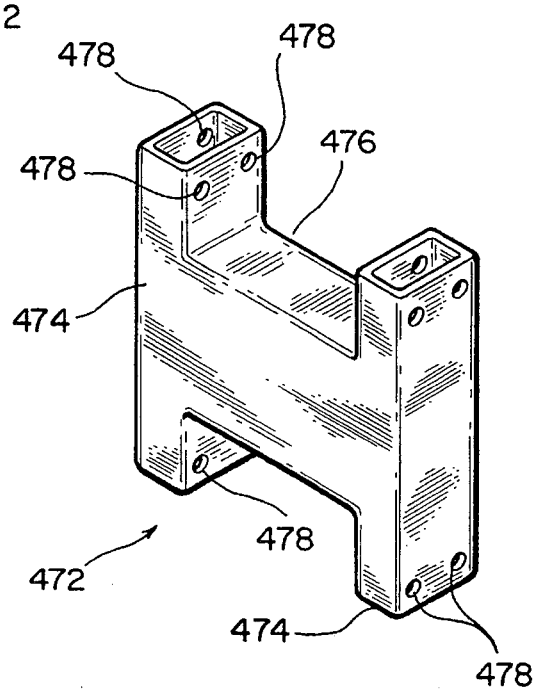
FIG. 38 shows a perspective view of a double T-bar connector.
Figure 37:
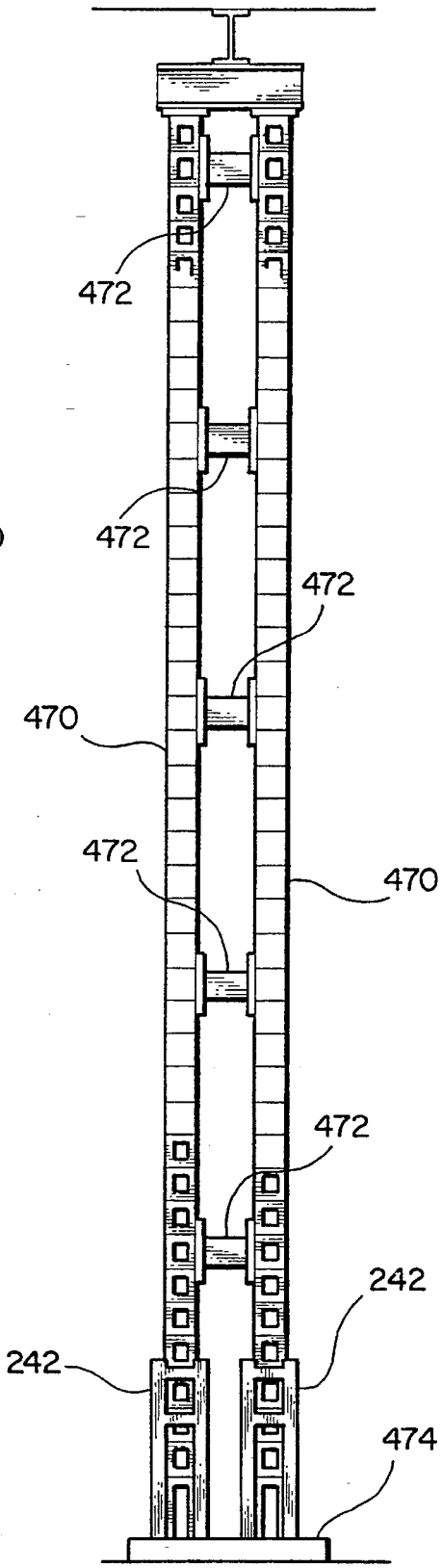
FIG. 37 shows two posts constructed from cribs connected by double T-bar connectors.

FIG. 37 shows an arrangement similar to that of FIG. 36, with a pair of posts 470 constructed from cribs 100 having loading frames 242 at their bases. However, rather than being connected by horizontal crib beams, posts 470 are connected by a plurality of double T-bar connectors 472. As illustrated in FIG. 38, a double T-bar connector includes a pair of rectangular tubes 474 connected by a tubular beam 476. Alternatively, a section of I-beam (not shown) may be used in place of tubular beam 476. Rectangular tubes 474 have a pair of holes 478 at each end for mounting on cribs 100 in the same manner as T-bar connectors 194 shown in FIGS. 12 and 13, and as described above with reference to those figures. The arrangement of FIG. 37 may be used where a strong, concentrated load is required, such as for supporting and lifting a bridge segment. In addition, the arrangement of FIG. 37 may also be constructed in a three-dimensional manner (not shown), with four posts 470 connected by double T-bars in a box-like fashion. Such an arrangement is compact, and also has a high resistance to buckling.

Figure 40:
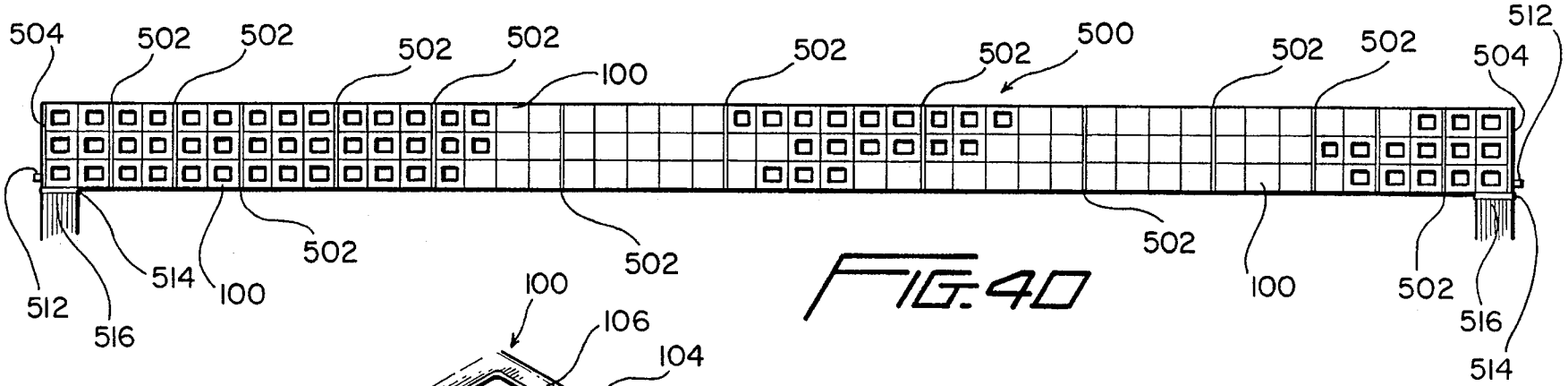
FIG. 40 shows a girder constructed from stacked cribs connected by shear plates.
Figure 39:
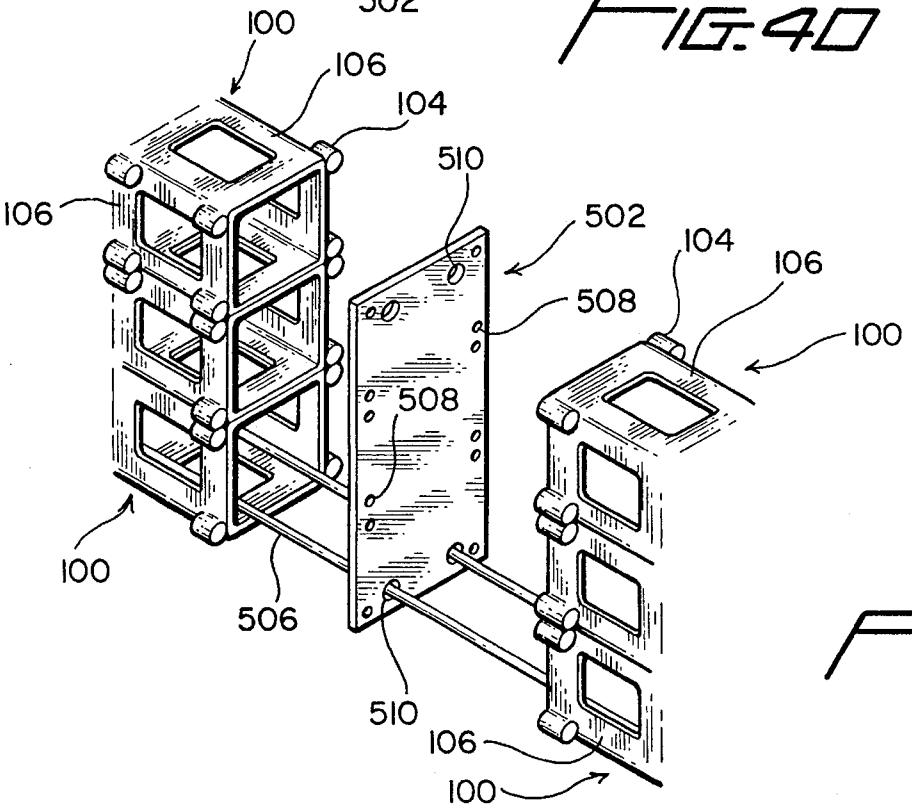
FIG. 39 shows a shear plate and its method of assembly to a plurlity of stacked cribs.

It is also possible to create high-strength structures from cribs 100 by placing a plurality of cribs 100 adjacent to one-another so that side walls 106 are in contact, and then mating the plurality of cribs to a shear plate 502, as illustrated in FIG. 39. A plurality of stacked cribs 100 and shear plates 502 may be used to construct numerous structures, such as a built-up girder 500, as shown in FIG. 40.

It may be seen in FIG. 39 that since short tubes 104 of cribs 100 are mounted on two of opposing side walls 106, cribs 100 may be stacked by placing in contact the side walls 106 not having short tubes 104 mounted thereon. Shear plate 502 may be used for connecting such a plurality of stacked cribs 100. Shear plate 502 is a rectangular plate to which the stacked cribs may be mated, and which is sized to accommodate the desired number of stacked cribs 100. In the example shown, shear plate 502 includes three sets of four bolt holes 508 for use in mating shear plate 502 to three stacked cribs 100. Shear plate 502 may be sandwiched between two sets of stacked cribs, as shown in FIG. 39, with bolts 110 of FIG. 1 passing through short tubes 104 and holes 508 in shear plate 502. In addition, while FIGS. 39 and 40 show three cribs 100 stacked together and mated with shear plate 502, it will be apparent that any number of cribs may be so stacked depending on the desired strength of the structure being constructed, with the dimensions of shear plate 502 being correspondingly altered.

Typically, the flexural strength of a girder, such as girder 500, increases exponentially with the height of the girder. A two-crib-high girder is four times stronger than a one-crib-high girder, a three-crib-high girder is nine times stronger than a one-crib-high girder, etc. Also, shear plates 502 are spaced more closely together near the ends of girder 500 than they are near the middle of girder 500. This is because the shear stresses on girder 500 are highest at the ends of girder 500, and decrease to zero at the middle of girder 500.

To increase the strength of girder 500, post tensioning rods or cables 506 may be included. Shear plate 502 includes four tension rod holes 510 which are positioned to enable tension rods 506 to pass through the interiors of cribs 100, as illustrated in FIG. 39. Tension rods 506 continue to pass through the full length of girder 500, and are anchored by anchors 512 at either end of girder 500 to end shear plates 504. End shear plates 504 are located at either end of girder 500. End shear plates 504 are similar to shear plate 502, except end shear plates 504 are thicker to accommodate the greater stresses imparted by anchors 512 which anchor tension rods 506. The ends of girder 500 rest on bearing plates 514, which in turn rest on abutments or other types of supports 516.

It will be clear to those familiar with the construction industry that built-up girders, of which girder 500 is one example, may be very useful in locations where a roof of a multistory building needs strengthening to accommodate signs or equipment. Cribs 100 and shear plates 502 may be carried to the top floor of the building by elevator and assembled on-site, eliminating the need for cranes or other special equipment. Also, in cases where a temporary bridge is required to be built in difficult terrain, parts of the present invention may be more easily transported to the construction site than is the case under conventional construction means. For example, cribs 100 and accessory parts may be transported to the construction site by helicopter. In such a case cribs 100 may be constructed from aluminum or other light-weight material.

From the foregoing, it should be clear that a set of cribs and a set of accessory parts, as shown and described, make it possible to construct support structures of a variety of configurations. A primary feature of this invention resides in the fact that a support structure of one configuration can be taken apart and the parts can be re-used to make entirely different support structures. As a result of this feature, there is no waste of materials. In addition, while hydraulic jacks are the preferred elevating mechanism, it will be apparent that other lifting devices may be substituted without departing from the scope of the present invention.

While preferred embodiments of a method and apparatus for a modular support and lifting system in accordance with the present invention have been set forth fully and completely hereinabove, it will be apparent to one of skill in the art that a number of changes in, for example, the sizes and shapes of the various components, the materials used, the configurations constructed, and the like can be made without departing from the true spirit and scope of the present invention which is accordingly to be limited only by the following claims.

What is claimed is:

1. An apparatus for a modular structural support system for constructing temporary support structures, said apparatus comprising:

a plurality of generally identical cribs, said cribs having a first mating end, a second mating end, and four non-mating sides, whereby a first crib may be mated to a second crib for forming an elongate structure, said cribs also having openings on at least some of said non-matings sides able to receive various additional mounting components, said cribs further including connecting means for releasably mating said cribs to one another.

2. The apparatus of claim 1 wherein said connecting means includes a plurality of tubes affixed on said non-mating sides of said cribs near said first mating end and said second mating end, said tubes on a first crib aligning with said tubes on a second crib when a first crib is mated to a second crib for receiving bolts therethrough.

3. The apparatus of claim 1 further including a plug insertable into said openings in said cribs, said plug generally conforming to said openings and being connectable to a second plug insertable into said openings in a second crib, whereby a post formed from a plurality of said cribs, including therein said first crib, may be connected to a beam formed from a plurality of said cribs, including therein said second crib, by connecting said first plug to said second plug.

4. The apparatus of claim 1 further including a plug insertable into said openings in said cribs, said plug generally conforming to said openings and having a hole therethrough for connecting a tie rod by attaching a tie rod clevis by means of said hole.

5. The apparatus of claim 1 further including a t-bar for connecting a beam formed of a plurality of said cribs to a post formed from a plurality of said cribs, said t-bar including an elongate bar, a flange plate mounted on said bar for mating with a mating end of one of said cribs, and a shear plate mounted on the opposite side of said bar from said flange plate, said shear plate generally matching said openings in said cribs.

6. The apparatus of claim 1 further including a cube connector for connecting said cribs to each other, said cube having six planar mating faces for mating with said cribs, whereby said mating ends of said cribs may be releasably connected to said mating faces of said cube.

7. The apparatus of claim 1 further including a loading frame forming a sleeve-like enclosure for receiving a post formed of said cribs, said loading frame including a hydraulic jack for elevating said post, whereby said post may be elevated by said jack, and one of said cribs may be then added to the bottom of said post.

8. The apparatus of claim 1 further including a means for preloading a post formed of a plurality of said cribs, said preloading means including a pair of cradles mounted within said openings of said cribs, and a pair of jacks mounted on said cradles, said jacks being activated to place a preload on said post.

9. The apparatus of claim 1 further including a means for preloading a post formed of a plurality of said cribs, said preloading means being mounted on top of said post and including a piston mounted within a slotted sleeve, and a jack disposed below said piston, said jack being activated to place a preload on said post by bearing against said piston.

10. A method for constructing temporary support structures, said method comprising:

providing a plurality of generally identical cribs, said cribs having a first mating end, a second mating end, and four non-mating sides, with at least some of said non-mating sides having openings for receiving connecting accessories, said cribs further including connecting means for releasably connecting said cribs to one another whereby a first crib may be mated to a second crib for forming an elongate structure; and constructing a support structure by connecting a plurality of said cribs to each other.

11. The method of claim 10 further including constructing a plurality of posts from said cribs and providing said posts with a preloading means at the top of said posts.

12. The method of claim 11 wherein said preloading means includes a pair of cradles mounted within said openings in said cribs, and a pair of hydraulic jacks mounted within said cradles, said hydraulic jacks being activated to apply a preload to said posts.

13. A method of shoring and progressively elevating a structure, said method comprising:

providing a plurality of generally identical building elements, said plurality of building elements being releasably connectable for forming an elongate post;

locating a post constructed of a plurality of said building elements under a structure to be elevated, said post being located within a sleeve-like loading frame, said loading frame including a jack for elevating said post; and using said jack to elevate said post a sufficient distance to enable the placement of an additional building element on the bottom of said post, said jack then being resetable to elevate said post including said additional building element for adding more building elements, whereby a structure may thus be progressively elevated.

14. The method of claim 13 further including the step of providing a plurality of said posts for elevating different parts of a structure generally simultaneously.

15. The method of claim 13 further including the steps of:

providing a plurality of said posts; and structurally connecting said posts to provide a more stable structure.

16. The method of claim 15 further including the steps of:

connecting said posts by generally horizontal beams constructed by connecting a plurality of said building elements;

providing a plurality of post-to-beam connectors for connecting said beams to said posts;

providing a plurality of tie rods; and connecting said tie rods between said plurality of posts.

17. A shoring and jacking apparatus for progressively elevating a structure, said apparatus comprising:

a plurality of generally identical building elements, said building elements being rigidly connectable for forming an elongate post;

a loading frame, said loading frame being configured to receive said post in a sleeve-like manner; and a jack disposed within said loading frame, said jack being extendable for elevating said post, whereby, said jack may be used to elevate said post a sufficient distance to enable the placement of an additional building element on the bottom of said post, and further whereby said jack may then be reset to elevate said post including said building additional element for further elevating a structure.

18. The apparatus of claim 17 further including a plurality of said posts for use in elevating different parts of a structure generally simultaneously.

19. The apparatus of claim 17 further including a plurality of said posts, a plurality of post-to-beam connecting members, and a plurality of beams constructed by connecting a plurality of said building elements, said plurality of posts being connected structurally to each other by said beams, said beams being connected to said posts by means of said post-to-beam connecting members.

20. The apparatus of claim 17 further including a hydraulic preloading means located at the top of said post.

21. A shoring and jacking apparatus, said apparatus comprising:

a plurality of building elements, said building elements having a first mating end, a second mating end, and four non-mating sides, whereby a plurality of said building elements may be releasably connected to each other for forming an elongate post; and a jacking means for elevating said post, whereby said jacking means may be used to progressively elevate said post to enable the progressive addition to said post of additional said building elements.

22. The apparatus of claim 21 further including:

a preload module mounted on top of said post, said preload module including a piston mounted within a slotted sleeve, and a preload jack disposed below said piston, said preload jack being activatable to place a preload on said post by bearing against said piston.

23. The apparatus of claim 21 further including a plurality of said posts constructed from said building elements for use in elevating different parts of a structure generally simultaneously.

24. The apparatus of claim 21 in which said jacking means includes:

a sleeve-like loading frame which provides lateral support to said post while allowing said post to move in a vertical direction; and a jack associated with said loading frame, said jack being positioned for moving said post in a vertical direction.

25. A method for shoring and progressively elevating a structure, said method comprising:

providing a plurality of building elements, said building elements having a first mating end, a second mating end, and four non-mating sides, said building elements being releasably connectable to each other for forming an elongate post;

forming a post from a plurality of said building elements; and progressively elevating said post and a structure using a jacking means whereby additional said building elements may be progressively added to said post.

26. The method of claim 25 further including the step of preloading said post prior to progressively elevating said structure.

27. The method of claim 25 in which said jacking means includes:

a sleeve-like loading frame which provides lateral support to said post while allowing said post to move in a vertical direction; and a jack associated with said loading frame, said jack being positioned for moving said post in a vertical direction.

* * * * *